US007870705B2

(12) United States Patent
Wood et al.

(10) Patent No.: US 7,870,705 B2
(45) Date of Patent: Jan. 18, 2011

(54) PRODUCTION OF BAND-DRIVEN PACKAGES AND THEIR COMPONENTS

(75) Inventors: Timothy Michael Wood, Royston (GB); Adrian James David Howson, Colne (GB); Ian Dunckley, Ridgmont (GB); Cyrille Fuellemann, Schaffhausen (CH); Alfred Wipf, Jestetten (DE); Daniel Kummer, Neunkirch (CH)

(73) Assignee: Duff Design Limited, London (GB)

( * ) Notice: Subject to any disclaimer, the term of this patent is extended or adjusted under 35 U.S.C. 154(b) by 0 days.

(21) Appl. No.: 12/264,558

(22) Filed: Nov. 4, 2008

(65) Prior Publication Data

US 2009/0139187 A1 Jun. 4, 2009

Related U.S. Application Data

(63) Continuation of application No. PCT/GB2007/001687, filed on May 4, 2007.

(30) Foreign Application Priority Data

May 4, 2006 (GB) ..... 0608845.4

(51) Int. Cl.

| | |
|---|---|
| ***B65B 11/00*** | (2006.01) |
| ***B65B 43/00*** | (2006.01) |
| ***B65D 5/38*** | (2006.01) |
| ***B65D 6/06*** | (2006.01) |

(52) U.S. Cl. ..... 53/399; 53/412; 53/413; 53/449; 53/452; 53/133.3; 53/134.1; 53/169; 53/176; 53/558; 53/582; 493/87; 493/88; 206/745; 206/804

(58) Field of Classification Search ..... 53/399, 53/410, 412, 413, 449, 452, 456, 133.1, 133.3, 53/133.7, 134.1, 169, 176, 558, 580, 582, 53/586, 590, 593, 374.5; 206/745, 804; 493/84, 493/87, 88, 386; *B65D 5/38, 6/06*
See application file for complete search history.

(56) References Cited

U.S. PATENT DOCUMENTS 3,580,786 A 5/1971 Doane et al.

(Continued)

FOREIGN PATENT DOCUMENTS

EP 1140639 A1 12/1999

(Continued)

OTHER PUBLICATIONS

International Search Report pertaining to International application No. PCT/GB2007/001687 dated Dec. 12, 2007.

(Continued)

*Primary Examiner*—Stephen F Gerrity
(74) *Attorney, Agent, or Firm*—Dinsmore & Shohl LLP

(57) ABSTRACT

Methods are disclosed for making a band-driven package or a band-drive component for a package, and machines for performing the methods. One method comprises feeding first and second flexible webs in a feed direction, one web being fed each side of a substrate such that the webs are in mutual face-to-face disposition ahead of and behind the substrate with respect to the feed direction; joining the face-to-face webs at a first join ahead of the substrate and at a second join behind the substrate, the joins bounding web portions that together encircle the substrate between the joins; and dividing the joined web portions from the remainder of the webs such that the joined web portions together define a band that encircles the substrate, to be slid around the substrate in use of the package.

63 Claims, 11 Drawing Sheets

U.S. PATENT DOCUMENTS

| | | | | |
|---|---|---|---|---|
| 4,372,098 | A | 2/1983 | Mason | |
| 5,584,163 | A * | 12/1996 | Storandt | 53/410 |
| 6,557,700 | B1 * | 5/2003 | Wharton | 206/745 |

FOREIGN PATENT DOCUMENTS

| | | | |
|---|---|---|---|
| EP | 1 140 639 | B1 | 5/2003 |
| GB | 2265877 | A * | 10/1993 |
| GB | 2 428 236 | A | 1/2007 |
| JP | 02057518 | A * | 2/1990 |
| WO | WO 9824696 | A1 * | 6/1998 |
| WO | 0038999 | | 7/2000 |
| WO | 2006000172 | A1 | 1/2006 |
| WO | 2007131822 | A1 | 11/2007 |

OTHER PUBLICATIONS

International Preliminary Report on Patentability pertaining to International application No. PCT1GB2007/001687 dated Nov. 4, 2008.

* cited by examiner

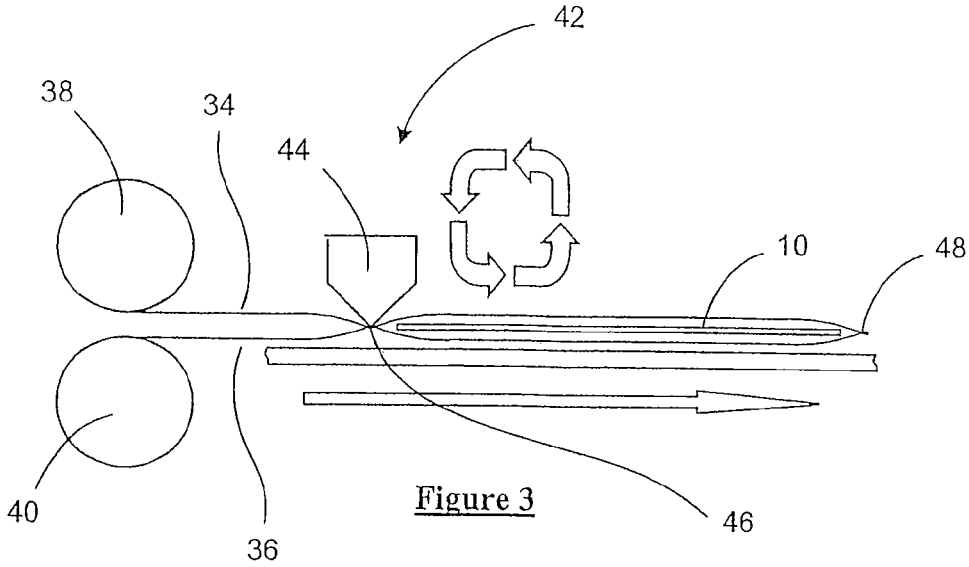
Figure 3
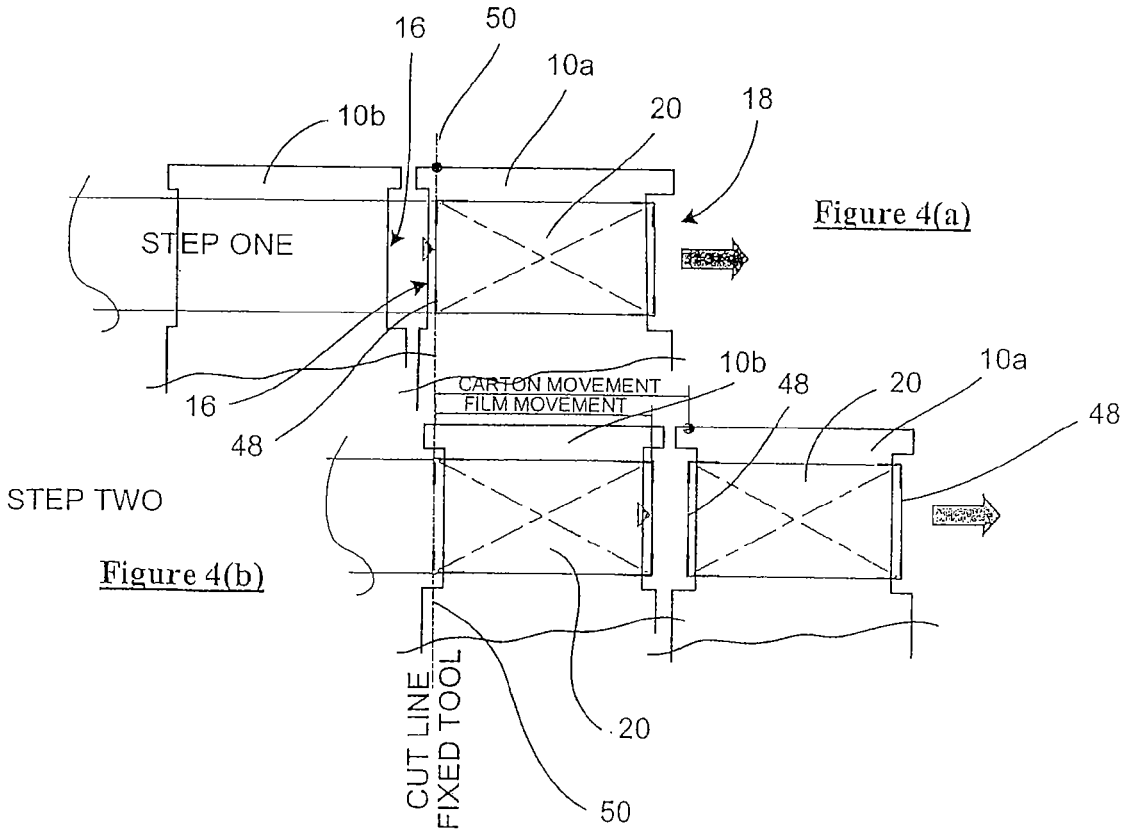
Figure 4(a)
Figure 4(b)

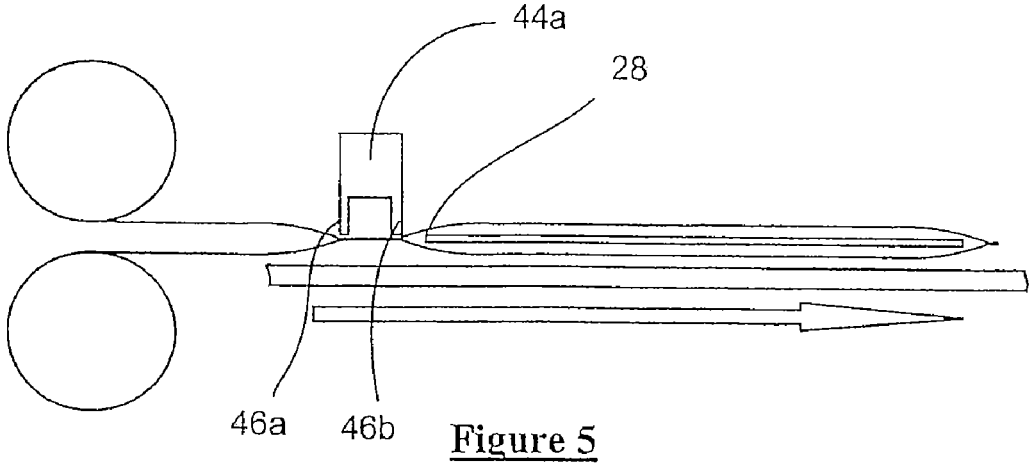
Figure 5
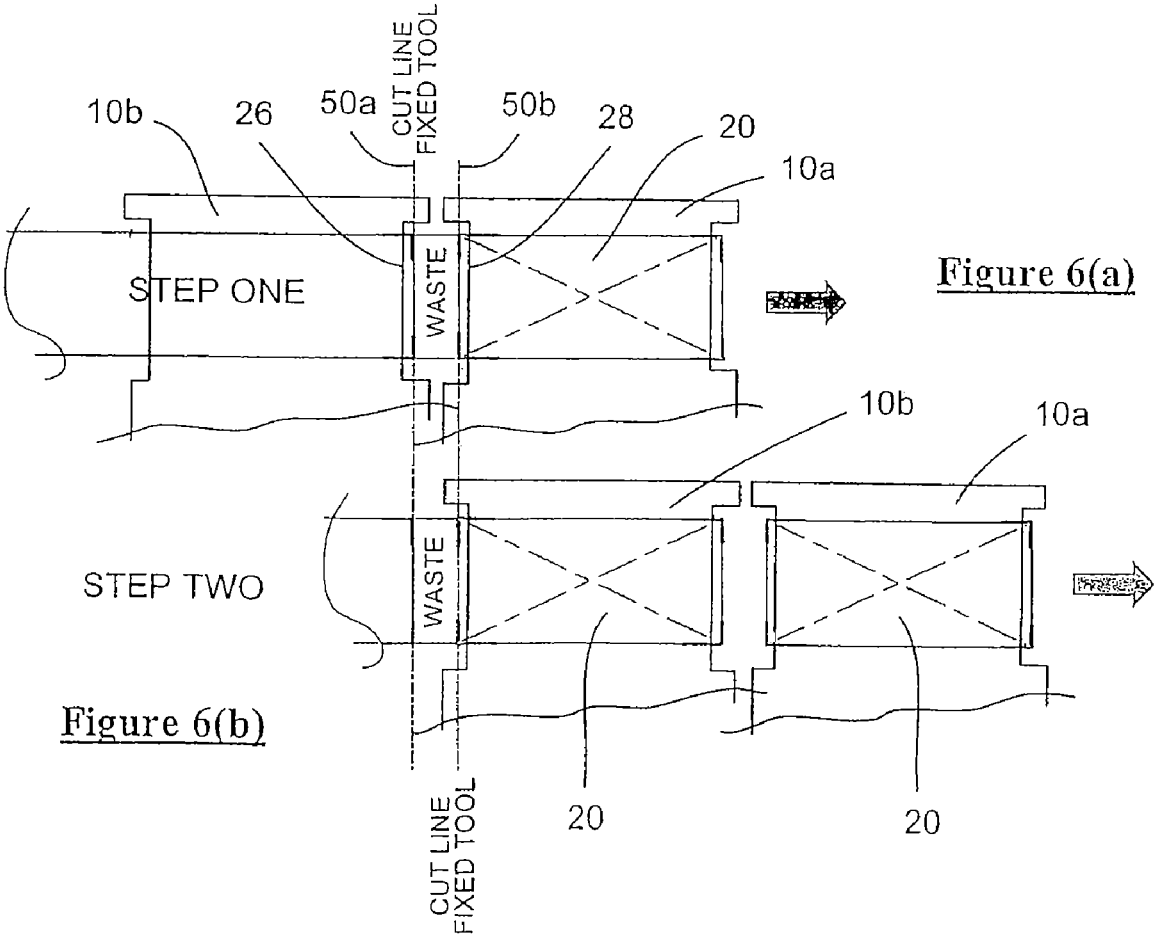
Figure 6(a)
Figure 6(b)

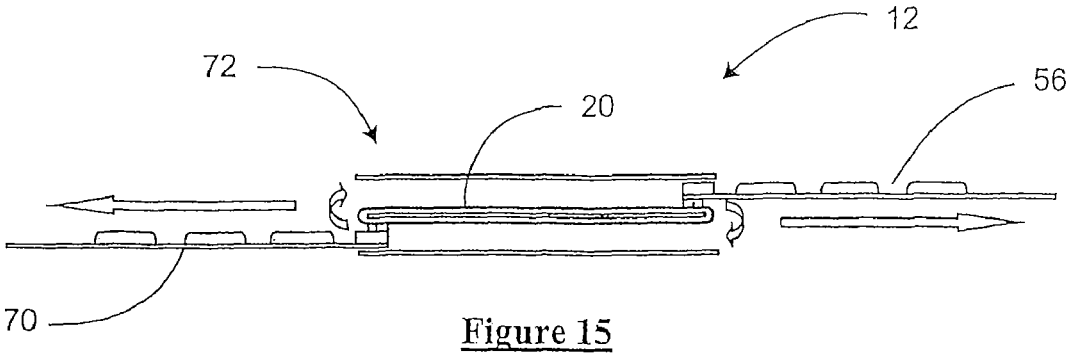
Figure 15
Figure 16(a)
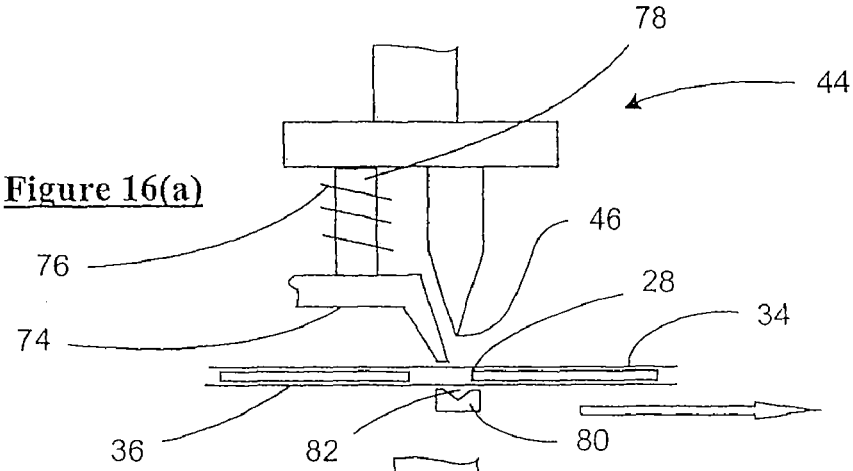
Figure 16(b)
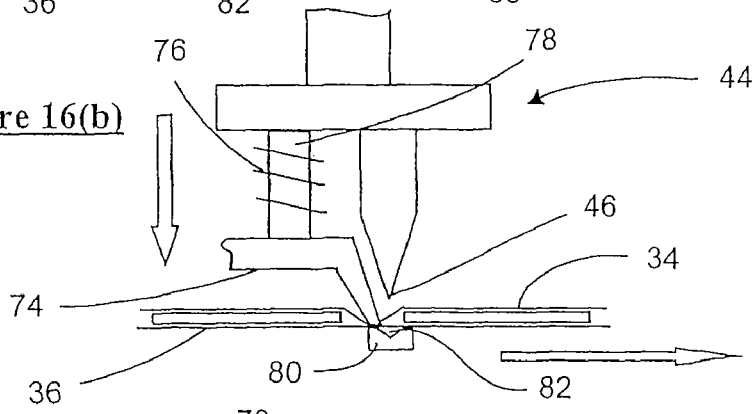
Figure 16(c)
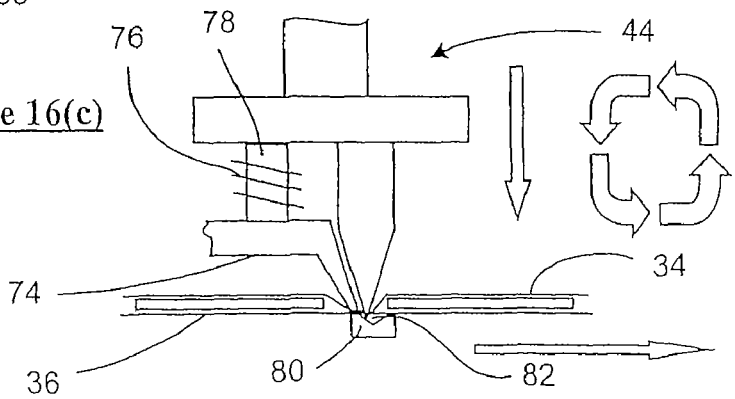

PRODUCTION OF BAND-DRIVEN PACKAGES AND THEIR COMPONENTS

CROSS-REFERENCE TO RELATED APPLICATIONS

This application is a continuation of PCT International Publication No. WO 2007/129090, published Nov. 15, 2007, and bearing an international filing date of May 4, 2007.

TECHNICAL FIELD

This application relates to the production of band-driven packages and of band-drive components for such packages, particularly packages exemplified by patents such as EP 1140639.

BACKGROUND

Packages exemplified by EP 1140639 are characterised by a band that extends around a supporting structure, such as a planar divider, to slide around that structure in use. The divider is typically supported within a sleeve defining the overall size and shape of the package; the divider and the sleeve may be integral panels of a common folded blank. Tab members are attached to the band, one each side of the divider, such that moving one tab member out of the package slides the band around the divider. That movement of the band, in turn, drives the other tab member to move out of the package in an opposite direction. Conversely, movement of one tab member back into the package also, via the band, drives the other tab member back into the package. The band therefore acts as a drive belt that couples the tab members for opposing movement into and out of the package.

One or both of the tab members can be trays or other structures such as blister packs adapted to support, and optionally to display, the contents of the package. It is also possible for one of the tab members simply to display information such as branding or instructions for use of the contents of the package. For example, a tab member can support an instruction leaflet which may fold out when that tab member is pulled out of the package to drive movement of the other tab, which other tab thereby carries the contents of the package out of the package in the opposite direction.

The subject matter of EP 1140639 is incorporated into this specification by reference.

SUMMARY

There are challenges for producing band-driven packages or cartons at high speed. In this context, 'high speed' implies production at a rate in excess of about 100 packages per minute, per single-lane or single-head machine, although the invention is not limited to any particular production rate. For example, embodiments of the invention can be applied to a machine that runs at a rate of less than 100 packages per minute; conversely, embodiments of the invention could work at production rates as high as 150 to 250 packages per minute, per machine.

These speeds are given merely by way of context and do not limit the invention. Thus, embodiments of the invention do not exclude machines or processes that may achieve production rates greater then 250 packages per minute, per machine. For example, embodiments of the invention encompass machines that may have more than one lane and more than one band-forming head: such parallel processing multiplies the speed of the machine.

Machines capable of high-speed production are advantageous to suit high-volume applications such as packaging for pharmaceuticals. Pharmaceutical applications will be used to exemplify the invention in this specification, with blister packs for tablets or capsules serving as one or both of the tab members of the package. However, embodiments of the invention are not limited to packages for any particular application. Nor are such embodiments limited to the production of complete packages: certain aspects of the invention relate to the production of band-drive components that can be made into, or incorporated into, packages in subsequent manufacturing operations. Those subsequent operations may be performed at a different manufacturing facility following transport of the band-drive components from one location to the other.

In mass production, there are difficult challenges in placing the band onto a blank or other supporting structure, while maintaining the close sliding fit that is essential to smooth running of the band when the package is in use. For lateral location, the band typically runs within the confines of cutouts in the edges of the blank that define a relatively narrow neck portion of the blank. Bearing in mind the need for a close sliding fit of the band around the blank, this means that the overall width of the blank to the sides of the neck portion is greater than the length of the flattened band; consequently, it is not possible simply to slide an unbroken band over a flat blank.

In an existing manufacturing process, a continuous, unbroken band is produced by cutting orthogonally across a parallel-sided tube of plastics film. The tube can be extruded in that form or, more practically, longitudinally welded from a sheet. The band is then held in a loop and a flat elongate cardboard blank is bent resiliently about its central longitudinal axis to reduce its width, whereupon the blank is inserted into the looped band while the blank is held in that narrow curved shape. When released, the blank regains its flat shape and hence its full width to support the band in a close sliding fit for smooth running around the blank.

Whilst this existing manufacturing process works reasonably well for producing batches of band-driven packages, it does not lend itself to mechanised production and is usually performed by hand. This restricts production rates, involves high labour costs (or high transport costs to and from sources of inexpensive labour) and introduces quality-control challenges.

According to one aspect, a method of making a band-driven package or a band-drive component for a package is provided. That method comprises feeding first and second flexible webs in a feed direction, one web being fed each side of a substrate such that the webs are in mutual face-to-face disposition ahead of and behind the substrate with respect to the feed direction. The webs are suitably identical strips of heat-weldable plastics material, and the substrate is suitably a flat panel such as a carton blank that can be folded to make the band-driven package including a sleeve around the band and tab members attached to the band.

The method then comprehends joining the face-to-face webs at a first join ahead of the substrate and at a second join behind the substrate, the joins bounding web portions that together encircle the substrate between the joins. Joining may be effected by welding. Once joined, the joined web portions are divided from the remainder of the webs such that the joined web portions together define a band that encircles the substrate, to be slid around the substrate in use of the package.

Preferably the webs run parallel to each other in the feed direction where the substrate lies between the webs, and the webs are strips fed from reels.

For lateral location, the webs are advantageously aligned with a narrow neck portion of the substrate such that the band encircles the substrate at the neck portion. The band suitably slides in use around a leading edge of the substrate at the neck portion and a trailing edge of the substrate at the neck portion parallel to the leading edge, the edges being orthogonal to the feed direction of the webs.

Elegantly, the web portions may be divided from the web along a join, preferably immediately after making the join. For example, where the joins are effected by welding, the web portions may be divided from the web by melting through the web after welding.

To allow a join to be made as close as possible to an edge of the blank, the method of the invention contemplates pressing together the webs before joining. For example, a stripper bar may be advanced to press the webs together and then a welding head may be advanced into contact with the pressed-together webs to weld the webs together.

To minimise waste and to ensure a close sliding fit of the band around the substrate, it is preferred that relative longitudinal movement takes place between the substrate and webs such that the substrate moves closer to the first join after the first join has been made. That relative longitudinal movement ends when the substrate bears against the first join.

Relative longitudinal movement may be achieved in various ways. For example, the substrate may move more quickly in the feed direction than the webs. To that end, the substrate may be driven by a primary conveyor means and the webs may be driven by a secondary conveyor means moving at a lower speed than the primary conveyor means. Where the substrate is elongate, the primary conveyor means suitably supports one end of the substrate and the secondary conveyor means suitably supports the other end of the substrate.

It is preferred that the second join is made after the first join, in which case relative movement between the substrate and the first join advantageously takes place after the first join is made and before the second join is made. For example, the second join may be made when the substrate bears against the first join, immediately behind the substrate.

In mass-production, it is envisaged that a plurality of substrates will be fed successively between the webs, and that the webs will be joined in gaps between successive substrates of the plurality. Elegantly, the invention allows the second join behind one substrate also to serve as the first join ahead of the succeeding substrate.

Once formed, the band is preferably advanced around the substrate to move the joins inboard of leading and trailing edges of the substrate. This positions the joins for the attachment of tab members over the joins, which reinforces the joins and prevents snagging of the joins upon edges of the substrate. Such snagging could otherwise interrupt the smooth running of the band around the substrate, and could introduce a risk of breakage. For example, the band may be advanced by relative movement between the substrate and band drive means in contact with the band. The band drive means may be the secondary conveyor means. Alternatively, the band drive means may comprise pinch rollers that contra-rotate on opposite sides of the band.

Where a band is turned around a substrate to the extent that a weld or other join weld lies slightly inboard of one of the edges of the substrate, a tab member may then be glued to the band using adhesive applied over or on both sides of the weld. Applying adhesive over or on both sides of the weld has two advantages: firstly reinforcing the weld; and secondly ensuring that the weld cannot move to the extent of snagging on an edge of the substrate when the package is used.

The provision for advancing the band around the substrate may be used independently of the first aspect of the invention, as part-finished components produced in accordance with the first aspect may be provided to a separate facility for further processing. Accordingly, from another aspect, a method of making a band-driven package is provided, the method comprising: providing a substrate encircled by a band, the band being defined by web portions joined to each other at least one join outboard of an edge of the substrate; and advancing the band around the substrate to move the join inboard of said edge of the substrate.

Further embodiments comprise applying at least one tab member to the band, for example by adhesive attachment to the band. For reinforcement, the adhesive is suitably applied to overlay or straddle a join of the band. The adhesive may be applied to the tab member before application of the tab member and the adhesive to the band. Alternatively, the adhesive may be applied to the band before application of the tab member to the adhesive on the band.

In another aspect, a machine for making a band-driven package or a band-drive component for a package is provided, the machine comprising: web feeders for feeding first and second flexible webs in a feed direction, one web being fed each side of a substrate such that the webs are in mutual face-to-face disposition ahead of and behind the substrate with respect to the feed direction; a web joiner for joining the face-to-face webs at a first join ahead of the substrate and at a second join behind the substrate, the joins bounding web portions that together encircle the substrate between the joins; and a web divider for dividing the joined web portions from the remainder of the webs such that the joined web portions together define a band that encircles the substrate, to be slid around the substrate in use of the package.

For continuous production, the web joiner and/or the web divider preferably move with the webs during joining and separation. For example, the web joiner and/or the web divider preferably move with rotary motion, although box motion is also possible.

A welding and cutting head may serve as both the web joiner and the web divider. In general, therefore, the web joiner and the web divider may be the same component.

As aforesaid, the machine may further comprise a web presser such as a stripper bar associated with the web joiner for pressing together the webs before joining. That web presser is preferably movable relative to the web joiner but is also movable with the web joiner with respect to the webs. Where the web divider is separate from the web joiner, a web presser may be associated with the web divider.

The machine preferably includes a tab member application station for applying at least one tab member to the band. There may be first and second tab member application stations, one station being downstream of the other with respect to a flow direction through the machine.

Folding means are preferably included in the machine for folding the substrate. The folding means may comprise at least one plough folding guide, more preferably a plurality of plough folding guides arranged to perform successive folding operations on the substrate as the substrate moves through the machine. Such folding means may be disposed both upstream and downstream of a tab member application station, such that folding takes place both before and after the application of a tab member to the band.

A second aspect of the invention involving advancing the band around the substrate may also be expressed as a machine for making a band-driven package, the machine comprising: means for receiving a substrate encircled by a band, the band being defined by web portions joined to each other at least one join outboard of an edge of the substrate; means for supporting the substrate while permitting the band to slide around the substrate; and drive means for advancing the band around the supported substrate to move the join inboard of said edge of the substrate. As aforesaid, the drive means suitably comprises a conveyor or pinch rollers for advancing the band around the substrate.

Additional features and embodiments of the invention include:

A method of making a band-driven package or a band-drive component for a package, the method comprising: feeding first and second flexible webs in a feed direction, one web being fed each side of a substrate such that the webs are in mutual face-to-face disposition ahead of and behind the substrate with respect to the feed direction; joining the face-to-face webs at a first join ahead of the substrate and at a second join behind the substrate, the joins bounding web portions that together encircle the substrate between the joins; and dividing the joined web portions from the remainder of the webs such that the joined web portions together define a band that encircles the substrate, to be slid around the substrate in use of the package.

In one form, the webs run parallel to each other in the feed direction where the substrate is between the webs, and wherein the webs may be strips fed from reels. In one embodiment, the substrate is a flat panel or a carton blank. The panels of the carton blank subsequently folded around the band. The panels may define a sleeve of the package.

In an embodiment, the band can slide in use around a leading edge of the substrate and a trailing edge of the substrate parallel to the leading edge, the edges being orthogonal to the feed direction of the webs. The method may also include an embodiment wherein the webs are aligned with a neck portion of the substrate such that the band encircles the substrate at the neck portion.

In another embodiment, the web portions are divided from the web along a join. Alternatively, the web portions are divided from the web immediately after making a join. The joins may be effected by welding. In one aspect, the web portions are divided from the web by melting through the web after welding.

In another embodiment, the webs are pressed together before joining. In one aspect, such joining may be accomplished by advancing a stripper bar to press the webs together and then advancing a welding head into contact with the pressed-together webs to weld the webs together.

In yet another embodiment, relative longitudinal movement is caused between the substrate and webs such that the substrate moves closer to the first join after the first join has been made. The relative longitudinal movement between the substrate and the webs may end when the substrate bears against the first join. The substrate can move more quickly in the feed direction than the webs. In one aspect, the speed differential between the substrate and the webs is varied during the band-forming cycle.

In yet another embodiment, the substrate is driven by a primary conveyor and the webs are driven by a secondary conveyor moving at a lower speed than the primary conveyor. When the substrate is elongate, the primary conveyor may support one end of the substrate and the secondary conveyor may support the other end of the substrate.

In another embodiment, the second join is made after the first join. In one aspect, relative movement between the substrate and the first join takes place after the first join is made and before the second join is made. The second join may be made when the substrate bears against the first join. Alternatively, the second join may be made immediately behind the substrate.

In yet another embodiment, a plurality of substrates are fed successively between the webs, and the webs are joined in gaps between successive substrates of the plurality. In one aspect, the second join behind one substrate is also the first join ahead of the succeeding substrate.

In another embodiment, the band is advanced around the substrate to move the joins inboard of leading and trailing edges of the substrate. In one aspect, the band is advanced by relative movement between the substrate and band drive in contact with the band. The band drive may be the secondary conveyor. Alternatively, the band drive may comprise pinch rollers. In one aspect, the pinch rollers contra-rotate on opposite sides of the band.

In another embodiment, the method may further comprise applying at least one tab member or insert to the band. In one aspect, the tab member or insert is adhesively attached to the band. The adhesive may be applied to overlay or straddle a join of the band. Alternatively, the adhesive is applied to the tab member or insert before application of the tab member or insert and the adhesive to the band. The adhesive may also be applied to the band before application of the tab member or insert to the adhesive on the band. The tab member or insert may be pressed against the band for a bond-forming period. Alternatively, the tab member or insert may be held against the band as the band and the substrate move in the feed direction.

In another embodiment, a machine for making a band-driven package or a band-drive component for a package is provided and comprises web feeders for feeding first and second flexible webs in a feed direction, one web being fed each side of a substrate such that the webs are in mutual face-to-face disposition ahead of and behind the substrate with respect to the feed direction; a web joiner for joining the face-to-face webs at a first join ahead of the substrate and at a second join behind the substrate, the joins bounding web portions that together encircle the substrate between the joins; and a web divider for dividing the joined web portions from the remainder of the webs such that the joined web portions together define a band that encircles the substrate, to be slid around the substrate in use of the package.

In one embodiment, the web joiner and/or the web divider move with the webs during joining and separation. In one aspect, the web joiner and/or the web divider move with a circular motion or in a box motion. The web joiner and the web divider may be the same component. In one aspect, a welding and cutting head serves as both the web joiner and the web divider. Alternatively, the web joiner may comprise opposed blades for crimping the face-to-face webs. The blades may be heated. In one aspect, the blades are carried by respective drums, one each side of the substrate and the webs. Each drum may carry a plurality of blades. Each blade may be mounted resiliently to its drum for radial movement with respect to an axis of rotation of the drum. The drums may be cooled.

In another embodiment, the machine may include a web presser associated with the web joiner for pressing together the webs before joining. In one aspect, the web presser is movable relative to the web joiner. The web presser may also be movable with the web joiner with respect to the webs.

In yet another embodiment, the substrate and the webs are driven by respective drives, the drives bring arranged to effect relative movement between the substrate and the webs such that the substrate moves closer to the first join after the first join has been made. When in use, the substrate drive may move more quickly in the feed direction than the web drive. The speed differential between the substrate and the webs may be varied during the band-forming cycle. In another aspect, the substrate drive may be a primary conveyor and the web drive may be a secondary conveyor moving at a lower speed than the primary conveyor. The primary conveyor may be spaced from and runs substantially parallel to the secondary conveyor. In another aspect, the web drive continues to engage the web after the band is formed so as to advance the band around the substrate. The machine may include pinch rollers for advancing the band around the substrate. The pinch rollers may contra-rotate on opposite sides of the band.

In another embodiment, the machine further comprises an application station for applying at least one tab member or insert to the band. In one aspect, the application station attaches the tab member or insert to the band with adhesive. The application station may comprise means for applying adhesive to the tab member or insert before application of the tab member or insert and the adhesive to the band. Alternatively, the application station may comprise means for applying adhesive to the band before application of the tab member or insert to the adhesive on the band. In another aspect, the application station is adapted to press the tab member or insert against the band for a bond-forming period. The application station may comprises a carrier movable in the feed direction to hold the tab member or insert against the band as the band and the substrate move in the feed direction. The carrier may also be movable transverse to the feed direction, towards and away from the band and the substrate. In another aspect, the machine is arranged to attach the tab member to the band at the location of a join. The machine may comprise first and second tab member application stations, one station being downstream of the other with respect to a flow direction through the machine.

In another embodiment, the machine further comprises folding means for folding the substrate. In one aspect, the folding means comprises at least one plough folding guide. The machine may also comprise a plurality of folding means arranged to perform successive folding operations on the substrate as the substrate moves through the machine. In one aspect, the folding means are disposed upstream and downstream of a tab member application station.

In yet another embodiment, a method of making a band-driven package is provided and comprises providing a substrate encircled by a band, the band being defined by web portions joined to each other at least one join outboard of an edge of the substrate; and advancing the band around the substrate to move the join inboard of said edge of the substrate. In one aspect, the band is defined by web portions joined to each other at first and second joins mutually opposed about the substrate, outboard of mutually opposed edges of the substrate, and the band is advanced to move the joins inboard of said edges of the substrate. The band may be advanced by relative movement between the substrate and band drive means in contact with the band. In another aspect, the method further comprises applying at least one tab member to the band. The tab member may be attached to the band at the location of a join. Alternatively, the tab member may be attached to the band by adhesive extending along or straddling the join. In another aspect, the method includes folding the substrate around the band.

In another embodiment, a machine for making a band-driven package is provided and comprises means for receiving a substrate encircled by a band, the band being defined by web portions joined to each other at least one join outboard of an edge of the substrate; means for supporting the substrate while permitting the band to slide around the substrate; and drive means for advancing the band around the supported substrate to move the join inboard of said edge of the substrate. In one aspect, the band is defined by web portions joined to each other at first and second joins mutually opposed about the substrate, outboard of mutually opposed edges of the substrate, and the drive means advances the band to move the joins inboard of said edges of the substrate. The drive means may comprise a conveyor. Alternatively, the drive means comprises pinch rollers for advancing the band around the substrate. The pinch rollers may contra-rotate on opposite sides of the band.

In another embodiment, the machine may further comprise a tab member application station for applying at least one tab member to the band. In one aspect, the tab member application station comprises means for applying adhesive to the tab member before application of the tab member and the adhesive to the band. Alternatively, the tab member application station comprises means for applying adhesive to the band before application of the tab member to the adhesive on the band. The machine may be arranged to attach the tab member to the band at the location of a join. The machine may also include first and second tab member application stations, one station being downstream of the other with respect to a flow direction through the machine.

In another embodiment, the machine may further comprise folding means for folding the substrate. The folding means may comprise at least one plough folding guide. Alternatively, the machine may comprise a plurality of folding means arranged to perform successive folding operations on the substrate as the substrate moves through the machine. In one aspect, folding means are disposed upstream and downstream of a tab member application station.

In yet another embodiment, a method of making a band-driven package or a band-drive component for a package is provided and comprises feeding a substrate between flexible web portions with the substrate bearing against a boundary of the web portions ahead of the substrate in a feed direction; and joining the web portions at a join behind the substrate whereby the web portions form a band that encircles the substrate. In one aspect, the method includes feeding first and second flexible webs in the feed direction, one web being fed each side of the substrate such that the webs are in mutual face-to-face disposition ahead of and behind the substrate with respect to the feed direction; joining the face-to-face webs to define the boundary ahead of the substrate and the join behind the substrate, the boundary and the join bounding the web portions that together form the band that encircles the substrate; and dividing the web portions from the remainder of the webs at the join behind the substrate, whereby the band may be slid around the substrate in use of the package. Relative longitudinal movement may take place between the substrate and the web portions such that the substrate advances with respect to the web portions before the join is made behind the substrate. The method may further include a plurality of substrates which are fed successively, and the joins are made in gaps between successive substrates of the plurality. The join behind one substrate may also be the boundary ahead of the succeeding substrate. The web portions may be portions of the same web.

In another embodiment, a machine for making a band-driven package or a band-drive component for a package is provided and comprises a substrate feeder for feeding a substrate between flexible web portions in a feed direction; and a web joiner for joining the web portions at a join behind the substrate whereby the web portions form a band that encircles the substrate. In one aspect, the machine includes web feeders for feeding first and second flexible webs in the feed direction, one web being fed each side of the substrate such that the webs are in mutual face-to-face disposition ahead of and behind the substrate with respect to the feed direction, wherein the web joiner is adapted to join the face-to-face webs at a boundary ahead of the substrate and at the join behind the substrate, the boundary and the join bounding the web portions; and a web divider for dividing the joined web portions from the remainder of the webs such that the joined web portions together define a band that encircles the substrate, to be slid around the substrate in use of the package. In one aspect, the web joiner and/or the web divider move with the webs during joining and separation. The web joiner and/or the web divider may move with a circular motion or in a box motion. The web joiner and the web divider may be the same component. The substrate and the webs may be driven by respective drives, the drives bring arranged to effect relative longitudinal movement between the substrate and the web portions such that the substrate advances with respect to the web portions before the join is made behind the substrate.

BRIEF DESCRIPTION OF THE DRAWINGS

In order that the invention may be readily understood, reference will now be made, by way of example, to the accompanying drawings in which:

FIG. 3 is a schematic side view of the creation of a band around a blank to make a band-drive component, showing how the band is completed by welding and cutting through two overlaid strips of plastics material adjacent a trailing edge of the blank;

FIGS. 4(*a*) and 4(*b*) are schematic plan views showing successive manufacturing steps, FIG. 4(*a*) corresponding to FIG. 3 and FIG. 4(*b*) showing the next manufacturing step, namely moving the next blank to bear against the weld made in FIGS. 3 and 4(*a*);

FIG. 5 is a schematic side view corresponding to FIG. 3 but showing a variant having a double-edged welding and cutting head that is currently not preferred;

FIGS. 6(*a*) and 6(*b*) are schematic plan views corresponding to FIGS. 4(*a*) and 4(*b*) but showing how the double-edged cutting tool of FIG. 5 generates waste of plastics film material;

FIG. 15 is a schematic sectional side view, to reduced scale, of the package completed in FIG. 14, showing the package inverted and the first and second tab members extending from the sleeve in use;

FIGS. 16(*a*), 16(*b*) and 16(*c*) are schematic side views of a practical welding and cutting head arrangement including a dynamic stripper bar;

DETAILED DESCRIPTION

Figure 1:
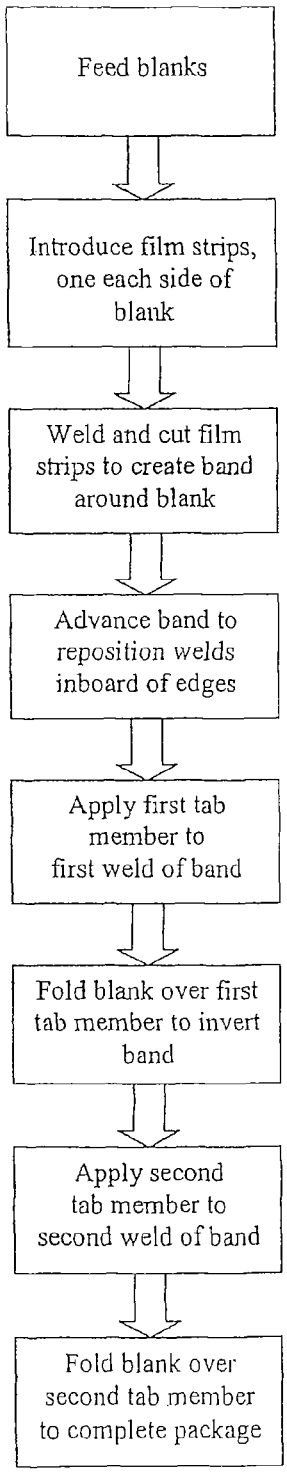
FIG. 1 is a flow diagram of the major process steps involved in making a band-driven package in accordance with the invention.
Figure 2:
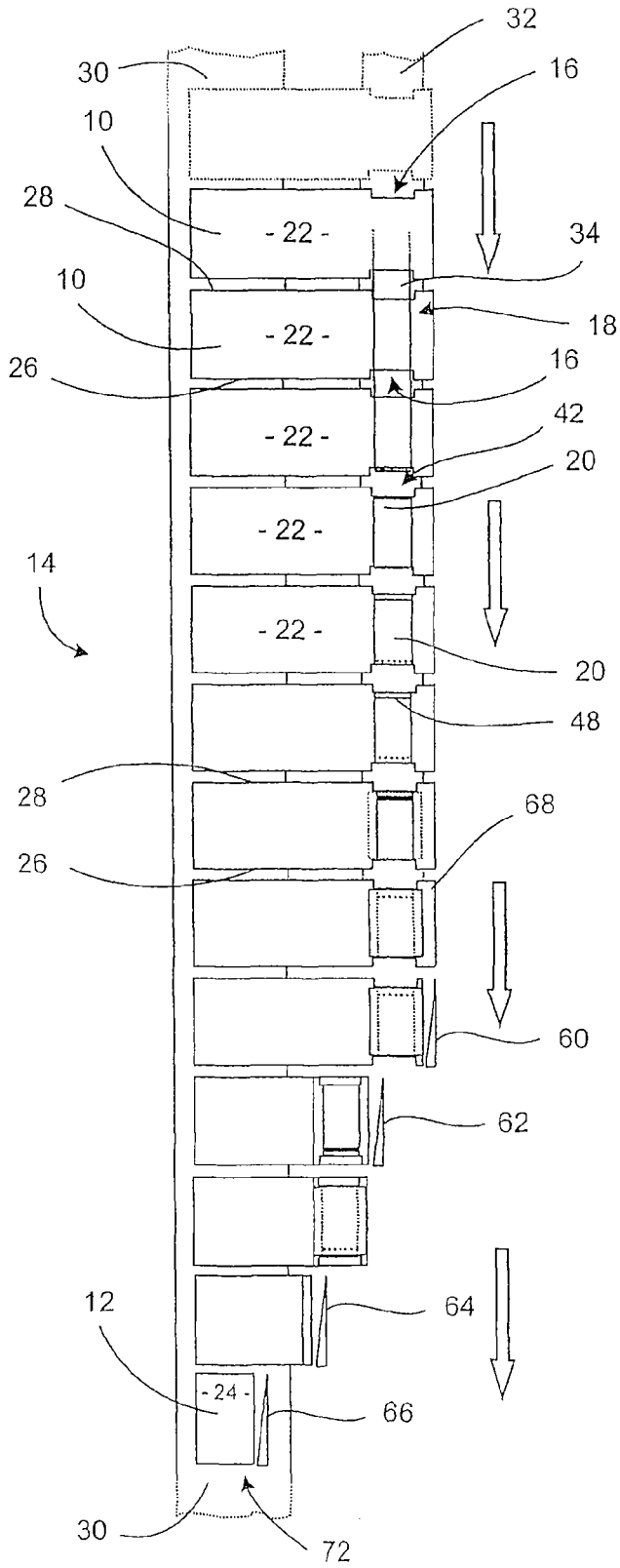
FIG. 2 is a schematic plan view of a linear package-making machine illustrating the process steps of FIG. 1 in the context of processing undergone by successive blanks flowing through the machine.

Referring firstly to FIGS. 1 and 2, the process steps of FIG. 1 are mirrored by the illustrations of FIG. 2, starting from the introduction of carton blanks 10 at the top of each figure to the production of finished band-driven packages 12 at the bottom of each figure.

For completeness, this specification will describe all of the process steps involved in making a package 12 in a continuous process in a single manufacturing facility, as summarised in FIGS. 1 and 2. However, it is emphasised that the invention does not necessarily require all of these steps to be performed, either in the order shown or indeed, in some cases, at all. Nor does the invention exclude other process steps that have been omitted from FIGS. 1 and 2 for brevity and clarity: such operations may include printing or customising the package 12, or inserting an instruction booklet into the package 12. The embodiment shown in FIGS. 18 to 25 shows one way of inserting an instruction booklet into a package.

It is particularly envisaged that the process summarised in FIGS. 1 and 2 may be interrupted such that some operations are performed at a later time or at a different manufacturing facility, following storage or transport of part-processed blanks. In particular, after a band 20 has been applied to a blank 10 to make a band-drive component, the remainder of the blank 10 is folded and glued to create a band-driven package 12 including that band-drive component. However, those subsequent folding and gluing operations are not essential to the invention in its broad sense.

Briefly, as shown in FIG. 1, the process and machine 14 that will be described herein takes blanks 10 and then introduces strips of film 34, 36, one each side of a blank 10 to sandwich the blank 10 between the strips 34, 36. The provision and relative disposition of the strips 34, 36 and the blank 10 will be described in more detail with reference to FIGS. 2 and 3. The strips 34, 36 are then welded together and cut to create a band 20 around the blank 10, the band 20 including one weld immediately ahead of the blank 10, i.e. downstream of the blank 10 and one weld immediately behind the blank 10, i.e. upstream of the blank 10. This will be described in detail with reference to FIGS. 4(*a*) and 4(*b*).

Figure 7A:
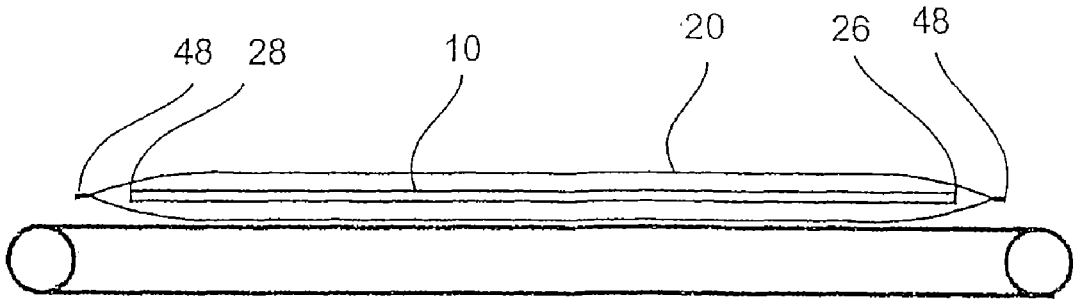
FIGS. 7(*a*) and 7(*b*) are schematic side views showing how the band may be advanced around the blank to reposition the welds.
Figure 7B:
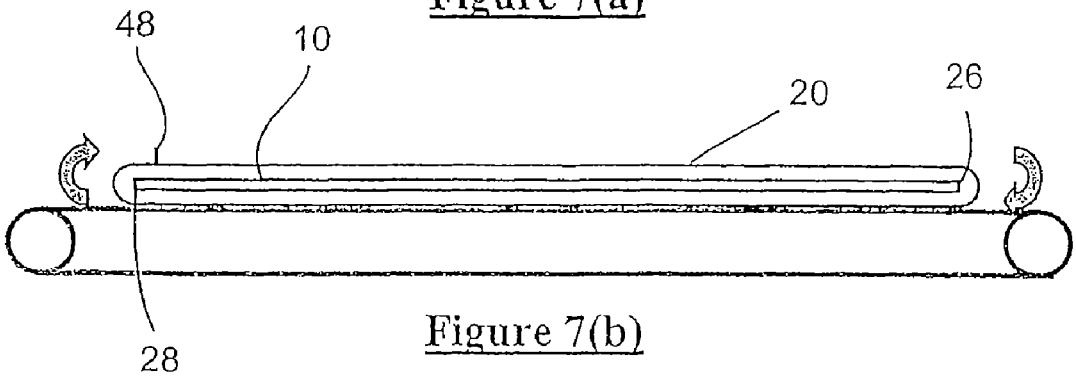
Figure 10:
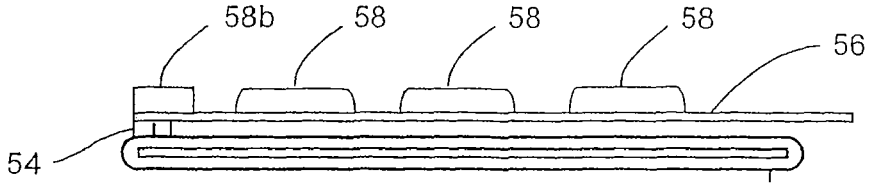
FIG. 10 is a schematic sectional side view showing the attachment of a first tab member to the adhesive strip applied to the band in FIG. 9.
Figure 11:
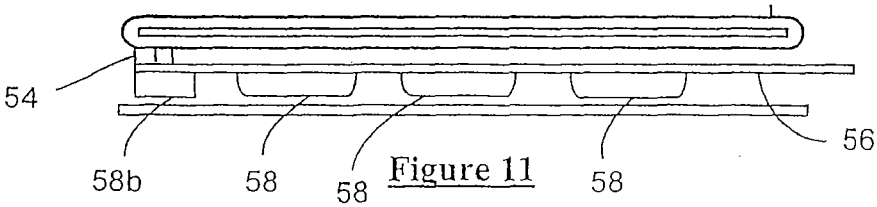
FIG. 11 is a schematic sectional side view showing the blank folded about the first tab member to invert the band and expose the other weld of the band.
Figure 13:
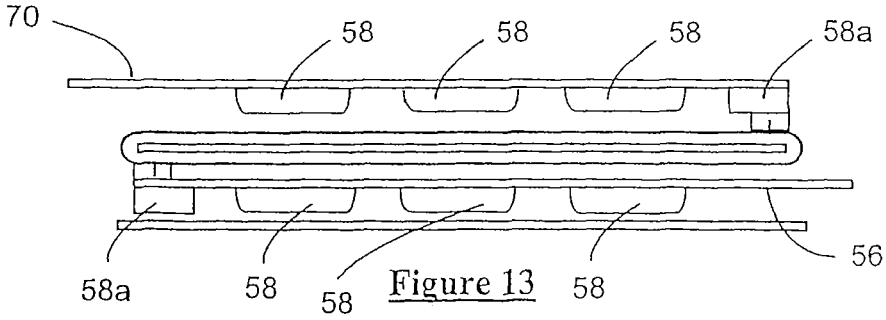
FIG. 13 is a schematic sectional side view showing the attachment of a second tab member to the adhesive strip applied to the band in FIG. 12.

Once the second weld and cut have been made to complete the band 20, the band 20 is advanced around the blank 10 to reposition the welds inboard of leading and trailing edges of the blank 10. Reference will be made to FIGS. 7(*a*), 7(*b*), 8(*a*) and 8(*b*) in this respect. This allows a first tab member such as a blister pack to be applied to one weld of the band 20, as shown in FIG. 10, whereupon the blank 10 is folded around the first tab member to invert the band 20, as shown in FIG. 11. This presents the other weld of the band 20, whereupon a second tab member such as another blister pack may be applied to that other weld, as shown in FIG. 13.

Figure 14:
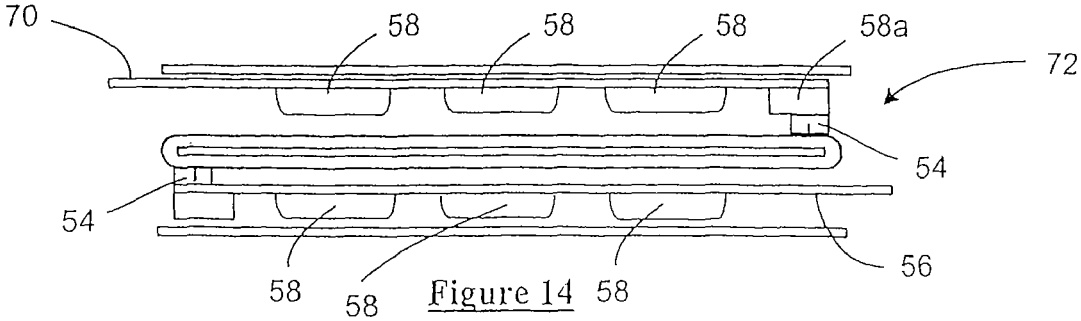
FIG. 14 is a schematic sectional side view corresponding to FIG. 13 but showing a panel of the blank folded over the second tab member to complete a sleeve of the package.

When the second tab member has been put in position, final folds are made as shown in FIG. 14 to complete the package 12, in which the blank 10 defines a sleeve around the tab members and also defines a divider that supports the band 20 to drive relative opposed movement of the tab members in use.

Referring now specifically to FIG. 2, a machine 14 embodying the invention processes cardboard blanks 10 that are generally oblong save for opposed cut-outs 16 in the long sides of the oblong, offset close to one end of the blank 10. As acknowledged in the introduction, such cut-outs 16 are already known: they define a relatively narrow neck portion 18 of the blank 10 around which a band 20 runs. Cutouts 16 are not essential to the present invention but they are preferred as the resulting neck portion 18 provides desirable lateral location for the band 20 in use.

The blanks 10 shown in FIG. 2 each have two major faces 22, 24, one uppermost 22 being visible in this figure and one lowermost 25 being hidden underneath the blanks 10. The blanks 10 also each have a leading edge 26 and a trailing edge 28 parallel to the leading edge 26. The terms 'leading edge' and 'trailing edge' have regard to the flow direction of successive blanks 10 through the machine 14, which direction is from top to bottom in FIG. 2 and from left to right in succeeding figures. In this embodiment, each of the leading and trailing edges 26, 28 includes the base of a respective one of the cut-outs 16.

A succession of blanks 10 are presented to the machine 14, the blanks being mutually spaced in transverse orientation such that their long sides including the cut-outs 16 are orthogonal to the flow direction. The blanks 10 may be supplied from interchangeable cartridges upstream of the machine of FIG. 2, in which blanks 10 are stacked to be dispensed from the cartridges one-by-one at regular intervals in the desired orientation. The blanks 10 preferably pass through the machine 14 in a generally horizontal plane with the lowermost face 24 of each blank 10 facing vertically down, although this orientation is not essential.

The blanks 10 are carried through the machine 14 by a horizontal primary conveyor 30 that grips the full-width major portion of each blank 10 opposed to the offset neck portion 18. A vacuum conveyor is preferred, although other conveyor means will be known to those skilled in the art and are not excluded from the invention.

In the much-simplified schematic view of FIG. 2, the blanks 10 are shown as being carried through the entire machine 14 by a single continuous primary conveyor. Whilst best practice in automation suggests that blanks 10 should not be released once they are under control, it will be evident to those skilled in the art that the blanks 10 may be passed from one conveyor means to another as they undergo the processes that will be described herein. Indeed, as mentioned above, the process summarised in FIGS. 1 and 2 may be interrupted, to be completed after an interval during which part-processed blanks 10 are stored or transported.

It is also possible for supplementary location means to be provided at any stage, such as clamping means or pinch rollers to press the blanks against the primary conveyor 30 during the folding steps. Those folding steps could otherwise cause the blanks 10 to slip relative to the conveyor 30, as vacuum belt location is relatively weak in shear under the moment loads imposed by folding. As the provision of supplementary location means such as pinch rollers will be routine to those skilled in the art, such means have been omitted from most of the drawings for clarity. However the embodiment shown in FIGS. 18 to 25 employs supplementary location means which are visible in the plan view of the machine shown in FIG. 19.

A secondary vacuum conveyor 32 runs parallel to and spaced from the primary conveyor 30, running under the neck portions 18 of the blanks 10 whose major portions are supported and gripped by the primary conveyor 30. The secondary conveyor 32 defines a drive surface in the same generally horizontal plane as that of the primary conveyor 30, such that each blank 10 is supported in that generally horizontal plane as it travels through the machine 14.

With reference now also to FIG. 3, two identical strips 34, 36 of flexible plastics film are drawn from respective reels 38, 40 and fed to a welding and cutting station 42 in the machine 14. Specifically, an upper strip 34 is fed parallel to the flow direction, in a generally horizontal plane above the upper faces 22 of the blanks 10 and in alignment with the neck portions 18 of the blanks 10. A lower strip 36 is fed in a parallel plane under the lower faces 24 of the blanks 10 between the blanks 10 and the secondary conveyor 32. The secondary conveyor 32 therefore grips the lower strip 36. The lower strip 36 is also aligned with the neck portions 18 of the blanks 10 and thus is in alignment with the upper strip 34, with the neck portions 18 of the blanks 10 sandwiched between the strips 34, 36. Thus, only the upper strip 34 is visible in the top plan view of FIG. 2 as the lower strip 36 is completely hidden underneath.

In practice, tension is maintained in the strips by tensioning means upstream of the welding and cutting station 42. The tensioning means have been omitted from FIG. 3 of the drawings for clarity but an example is shown in the embodiment of FIGS. 18 to 25, particularly in FIGS. 20 and 21. The tensioning means may brake the reels 38, 40 as they rotate or, preferably, the strips 34, 36 are passed in zigzag fashion through tensioners before the strips 34, 36 enter the welding and cutting station 42. Such tensioners preferably also define a reserve of strip material whereby the reels 38, 40 can be replaced without interrupting the preferably continuous operation of the machine 14. Fly splicing of strip material is possible, albeit with rejection of some packages 12 during the changeover process.

FIG. 3 shows a retractable welding and cutting head 44 at the welding and cutting station 42. The head 44 reciprocates up and down in use, in this embodiment with a box motion as shown to suit continuous rather than intermittent movement of blanks 10 through the machine 14. On its down stroke, the head 44 bears down upon the upper strip 34 closely behind or upstream of the trailing edge of the neck portion 18 of a blank 10, and presses the upper strip 34 into contact with the lower strip 36. FIG. 3 shows the lower strip 36 also raised against the upper strip 34; this may be achieved by a movable anvil (not shown in this figure) opposed to the head 44, although this is not essential.

The head 44 has a straight heated welding edge 46 that lies orthogonally with respect to the flow direction through the machine 14 and in parallel to the planes of the strips 34, 36 as they pass through the welding and cutting station 42. By way of example, the welding edge 46 of the head 44 has a land of 0.5 mm in width: this dimension is not critical but is currently preferred. It is also preferred, but not essential, that the welding edge 46 of the head 44 is of stainless steel. The edge 46 may be coated with PTFE to resist the accumulation of welding residues. A wide range of alternatives to PTFE will be apparent to the skilled reader.

When the hot welding edge 46 of the head 44 presses the upper strip 34 into contact with the lower strip 36, the upper strip 34 is firstly welded to the lower strip 36 at that location and then the welding edge 46 cuts through the welded-together strips 34, 36, which part under the tension in the strips 34, 36. This leaves an outwardly-protruding weld 48 between the joined strips 34, 36, parallel to the trailing edge of the blank 10: this may be seen from the preceding weld downstream of the head 44, to the right in FIG. 3. Welding and cutting the strips 34, 36 in this manner completes a band 20 around the blank 10 and frees the blank 10 from the strips 34, 36 that remain attached to the reels 38, 40. The weld 48 also becomes the first weld 48 that will define a band 20 around the succeeding blank 10, which blank is not shown in FIG. 3 but is shown in FIGS. 4(*a*) and 4(*b*) to be described below.

Details of a welding and cutting head will be described later in relation to FIGS. 16(*a*), 16(*b*) and 16(*c*) of the drawings and particularly in the practical embodiment shown in FIGS. 18 to 25.

Referring now to FIGS. 4(*a*) and 4(*b*), these show an advantageous refinement of preferred embodiments of the invention, in which relative movement takes place between blanks 10 and the surrounding strips 34, 36 between one weld 48 and the next. As will be explained, this relative movement has two main purposes, the first of which is to ensure that the band 20 is a close sliding fit around the neck portion 18 of the blank 10 and the second of which is to reduce the number of welds 48 and to avoid waste of the strip material.

FIG. 4(*a*) shows the same situation as in FIG. 3, save for the presence of a second, succeeding blank 10*b*. Here, a band 20 around a first blank 10*a* is completed by welding and cutting through the overlaid strips 34, 36 along a cut line 50 situated closely behind or upstream of the trailing edge of the neck portion 18 of that blank 10*a*. It will be noted that there is a substantial gap between that cut line 50 and the leading edge of the neck portion 18 of the second blank 10*b*. That gap is largely due to the combined depth of the opposed cut-outs 16 that define the neck portions 18 of the blanks 10*a*, 10*b*.

FIG. 4(*b*) shows the next step, in which the second blank 10*b* has been advanced relative to the strips 34, 36 as the blanks 10 and the strips 34, 36 advance together through the machine 14, such that the leading edge of the neck portion 18 of the second blank 10*b* lies adjacent to, and preferably bears against, the weld 48 made in FIG. 4(*a*). A band 20 may then be completed around the second blank 10*b* by welding and cutting along the cut line 50 as in FIG. 4(*a*).

Relative movement between the blanks 10 and the strips 34, 36 may be achieved by running the primary conveyor 30 slightly faster than the secondary conveyor 32, the blanks 10 moving at the speed of the primary conveyor 30 and the strips 34, 36 moving at the speed of the secondary conveyor 32. Such an arrangement is preferred in the machine 14 of FIG. 2 that relies upon continuous production, although other machines could achieve the necessary relative movement in different ways. The speed difference between the primary conveyor 30 and the secondary conveyor 32 may be varied in pulses, with the speed difference being increased to a maximum after each weld in a manner synchronised with the arrival of blanks 10 at the welding and cutting station 42.

The relative movement between the blanks 10 and the strips 34, 36 between one weld 48 and the next ensures that the welds 48 are as close as possible to the leading and trailing edges 26, 28 of the blank 10 so that the resulting band 20 is a close sliding fit around the neck portion 18 of the blank 10. A further benefit is to reduce the number of welds and especially to avoid waste of the strip material. In this regard, the cut-outs 16 that define the neck portion 18 of the blank 10 present a challenge because without relative movement between the blanks 10 and the strips 34, 36, a weld that completes one band 20 cannot also serve as the first weld of the succeeding band 20: instead, two welds would be necessary, and the strip material between those welds would be wasted. Whilst waste is best avoided for economic and environmental reasons, the main problem is how to handle the waste material in an automated process. If handling waste, the machine would inevitably become more complex and so more expensive and, potentially, less reliable.

To illustrate the problem of waste, FIGS. 5, 6(*a*) and 6(*b*) correspond to FIGS. 3, 4(*a*) and 4(*b*) but show an alternative embodiment without relative movement between the blanks 10 and the strips 34, 36 from one weld to the next. In this embodiment, a welding and cutting head 44*a* has two parallel edges 46*a*, 46*b* spaced apart slightly less than the gap between the trailing edge 28 of the first blank 10*a* and the leading edge 26 of the second blank 10*b*. Two welds and cuts may be made simultaneously by the head 44*a* along two parallel cut lines 50*a*, 50*b*, one 50*b* completing a band 20 around the first blank 10*a* and the other 50*a* being the first weld 48 of a band 20 around the second blank 10*b*. However, the result is a piece of waste strip material between the blanks 10*a*, 10*b*, which piece must be removed, handled and discarded.

Returning to the embodiment of the invention shown in FIG. 2, when a band 20 has been completed around the neck portion 18 of a blank 10 by a second weld 48 as described above, the blank 10 may then continue on the machine 14 for further processing or may be removed from the machine 14 for storage or transportation before further processing takes place. Whenever and wherever that further processing happens, the next processing step is to turn the band 20 around the blank 10 to the extent that the welds 48 lie slightly inboard of the leading and trailing edges 26, 28 of the blank 10. Tab members such as blister packs may then be attached to the band 20 using adhesive applied over the welds 48, which reinforces the welds 48 and prevents the welds 48 snagging on the leading and trailing edges 26, 28 of the blank 10 when the package 12 is used.

In an automated process, it is necessary to determine the location of the welds 48 with respect to the leading and trailing edges 26, 28. It is therefore desirable that the welds 48 do not move until they are deliberately caused to do so, especially where the blanks 10 are removed from the machine 14 for storage or transport which may cause the band 20 to slip around the blank 10. In this regard, the initial position of the welds 48 outboard of the leading and trailing edges 26, 28 helps to lock the band 20 against angular movement around the neck portion 18 of the blank 10, presenting resistance which needs to be overcome before the band 20 can slide freely. Thus, during storage and transport, the welds 48 are unlikely to slip from their initial outboard positions, especially when blanks 10 are stacked to sandwich the associated bands 20 between the blanks 10 of the stack.

If the positions of the welds 48 were to slip from their initial outboard positions, not only would the location of the welds 48 be unknown but also, over time, the band material would be likely to take a set and crease where it bends acutely around the leading and trailing edges 26, 28 of the blank 10. Such a set could also interrupt smooth running of the band 20 around the blank 10.

For the purposes of this description, it is assumed that the blanks 10 continue on the machine 14 so that the band 20 can be turned around the blank 10. Reference is therefore made to FIGS. 7(*a*) and 7(*b*) which show what happens downstream of the welding and cutting station 42. FIG. 7(*a*) shows a blank 10 encircled by a completed band 20, the band 20 having welds 48 initially outboard of the leading and trailing edges 26, 28 of the blank 10. The band 20 remains in contact with the secondary conveyor 32 whereas the blank 10 remains driven by the primary conveyor 30 which moves slightly faster than the secondary conveyor 32 as aforesaid. In consequence, the band 20 tends to turn around the blank 10. Once the initial resistance caused by the interaction between the welds 48 and the leading and trailing edges 26, 28 has been overcome, the band 20 is driven around the blank 10, clockwise in the view of FIG. 7(*b*), to the extent that the welds 48 lie slightly inboard of the leading and trailing edges 26, 28 as shown. The band 20 can then be disengaged from the secondary conveyor 32, for example by locally releasing vacuum applied by the secondary conveyor 32 or upon reaching the end of the secondary conveyor 32.

Thus, in the preferred embodiment of the invention shown in FIGS. 3, 4(*a*), 4(*b*), 7(*a*) and 7(*b*), the differential speeds of the primary and secondary conveyors 30, 32 ensure a close sliding fit of the band 20 around a blank 10, avoids waste of the plastics strip material, and optimally positions the welds 48 for further processing.

Figure 8A:
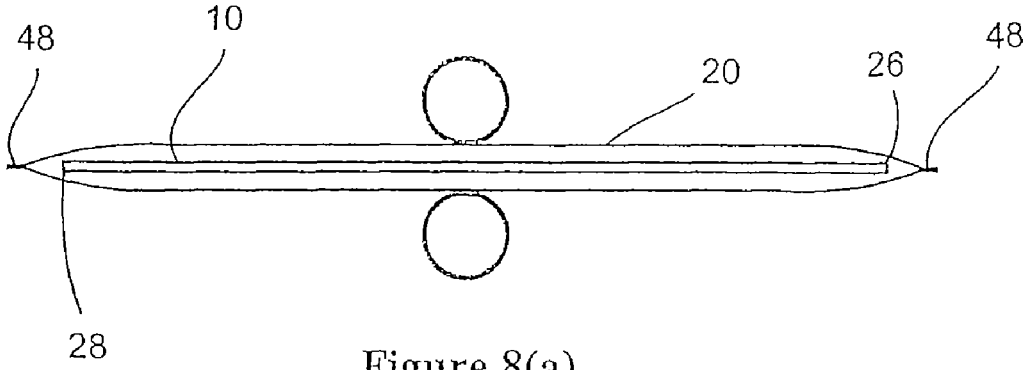
FIGS. 8(*a*) and 8(*b*) are schematic side views showing an alternative solution to that of FIGS. 7(*a*) and 7(*b*)
Figure 8B:
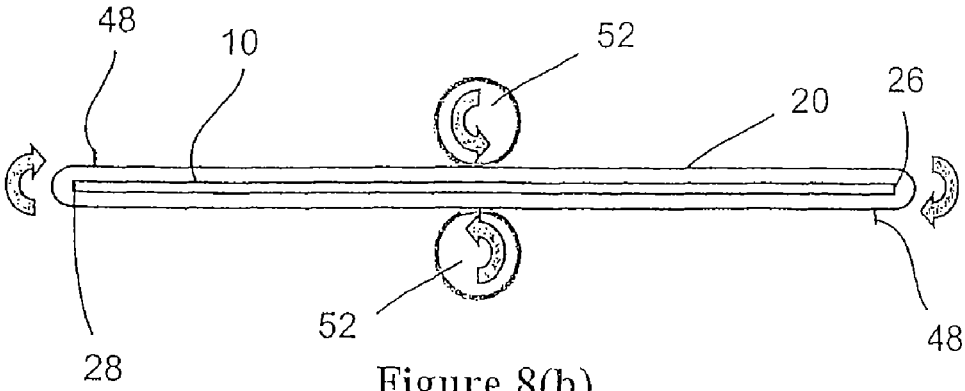

FIGS. 8(*a*) and 8(*b*) show another way of advancing the band 20 around the blank 10 to reposition the welds 48, in this case by counter-rotating rollers 52 that engage the band 20 above and below the blank 10 and index the angular position of the band 20 to the necessary extent. The embodiment shown in FIGS. 18 to 25 uses similar rollers, which are particularly illustrated in FIG. 25.

Figure 9:
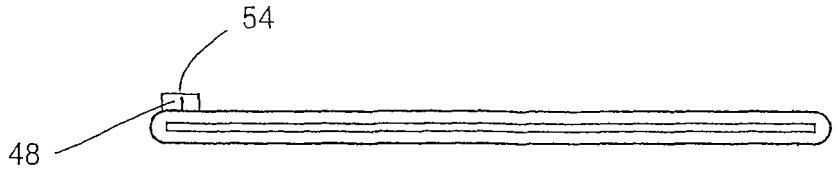
FIG. 9 is a schematic sectional side view showing the application of an adhesive strip over one weld of the band.

FIG. 9 shows an adhesive strip 54 applied to the band 20 over one of the welds 48. The strip 54 is a double-sided label of pressure-sensitive adhesive for precise dimensional control and for ease of handling: the labels may be supplied on a transfer tape. A tab member 56 such as a blister pack may then be applied to the adhesive strip 54 as shown in FIG. 10. It is also possible, and may be preferred, for adhesive 54 to be applied to the tab member 56 and for the tab member 56, with the applied adhesive 54, to be pressed onto the band 20 such that the adhesive overlies the weld 48.

Adhesive may alternatively be applied in gel or semi-solid form, for example by the application of a line of hot-melt adhesive or an array of dots of such adhesive. The embodiment shown in FIGS. 18 to 25 contemplates such a solution, for example parallel lines of adhesive dots applied parallel to each weld 48 with at least one line of dots being disposed to each side of the weld 48. In this way, a tab member attached to the band 20 bridges and strengthens the weld 48. Heat sealing and cyanoacrylate adhesives are possible alternatives.

The blister pack 56 constituting the tab member in FIG. 10 comprises rows of blisters 58 containing capsules or tablets of medicines or vitamins (not shown), these contents being dispensed by being pressed through a foil-covered base of the blister pack 56 in well-known manner. The blister pack 56 also has moulded-in stiffening formations 58*b* along its edge aligned with the adhesive strip. The stiffening formations 58*b* help to prevent the blister pack 56 sagging when slid out of the package 12, and can be vacuum-formed with the blisters 58. The stiffening formations 58*b* also serve as a spacer whereby a second blister pack 70, serving as a second tab member, can be applied to the band 20 in the same orientation as the first blister pack 56. This will be explained in more detail below with reference to FIG. 13. However, the second tab member could alternatively be applied in an orientation that is opposite to that of the first tab member.

Referring back to FIGS. 1 and 2, the next process after the application of the first blister pack 56 is folding about that blister pack 56 to invert the band. Folding is achieved by a succession of static plough folding guides 60, 62, 64, 66 that act upon the passing blanks 10 as they flow through the machine 14, each guide being located successively inwardly to effect another fold. In essence, the plough folding guides 60, 62, 64, 66 are ramps, preferably of hardened steel to resist the abrasiveness of the cardboard blanks 10.

FIG. 2 shows a simplified set of plough folding guides 60, 62, 64, 66 to achieve four folds: more folds may be necessary in practice. Each blank 10 is preferably pre-creased or scored to ease folding, and overfolding or pinch rollers may be employed to create sharp folded corners. The plough folding guides 60, 62, 64, 66 may be movable laterally to reconfigure the machine 14 for differently-sized blanks.

The first plough folding guide 60 lifts an edge portion 68 of the blank 10 beside the first blister pack 56. That edge portion 68 will become a side of the package 12. The second plough folding guide 62 then lifts the neck portion 18 of the blank 10 together with the first blister pack 56 attached to the band 20 at that location, folding the blank 10 about the first blister pack 56 such that the first blister pack 56 is inverted and lies upon the adjacent panel of the blank 10 as shown in FIG. 11.

Figure 12:
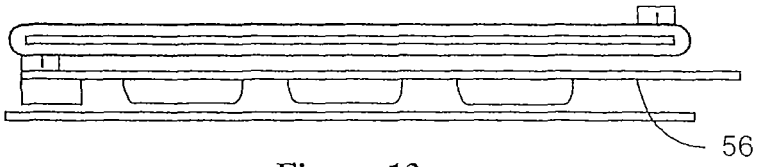
FIG. 12 is a schematic sectional side view showing the application of an adhesive strip over the weld of the band exposed in FIG. 11.

Inverting the first blister pack 56 as shown in FIG. 11 also inverts the band 20 and exposes the second weld 48 of the band 20. A strip 54 of pressure-sensitive adhesive is applied over that weld 48 as shown in FIG. 12 and then a second tab member in the form of a second blister pack 70 is attached to the adhesive 54 as shown in FIG. 13. For economies of scale, the second blister pack 70 is preferably identical to the first blister pack 56. As mentioned above in relation to FIG. 10, the stiffening formations 58*b* of the second blister pack 70 also serve as a spacer whereby the second blister pack 70 can be applied to the band 20 in the same orientation as the first blister pack 56, the spacer allowing for the depth of the blisters 58. This arrangement is preferred because when the pack 12 is opened as shown in FIG. 15, both blister packs 56, 70 are then exposed in the same orientation. However it is also possible to create the spacer in other ways, for example with a strip of foam coated on opposite sides with pressure-sensitive adhesive.

The package 12 is completed in FIG. 14 where another panel of the blank 10 is folded over the second blister pack 70 and glued down to the remainder of the folded blank 10 to create a sleeve 72. The package 12 is then ready for use, as shown in FIG. 15 in which the package 2 has been inverted and one of the blister packs 56 has been pulled out of the sleeve 72, driving the other blister pack 70 out of the sleeve 72 in the opposite direction by virtue of the band 20 connecting the blister packs 56, 70.

FIGS. 16(*a*), 16(*b*) and 16(*c*) show details of a possible welding and cutting head 44. In proof-of-concept testing, it was found that merely pressing a single heated welding edge against aligned strips 34, 36 may produce unreliable results. This is largely due to the difficulty of pressing together the strips 34, 36 very close to the trailing edge 28 of a blank 10. The embodiment shown in FIGS. 16(*a*), 16(*b*) and 16(*c*) therefore employs a dynamic stripper bar 74 that is floatingly attached to the head 44 for relative vertical movement with respect to the head 44. The stripper bar 74 is biased downwardly with respect to the head 44 by a spring 76 around a rod 78 that supports the stripper bar 74 for sliding vertical movement with respect to the head 44.

When the head 44 initially shown in FIG. 16(*a*) moves downwardly during a downward stroke, the stripper bar 74 moves ahead of the heated edge 46 of the head 44 to trap the aligned strips 34, 36 against an edge of an anvil 80 under the lower strip 36, opposed to the head 44. This state is shown in FIG. 16(*b*). Continued downward movement of the head 44 compresses the spring 76 between the stripper bar 74 and the head 44, allowing the heated edge 46 into welding and cutting contact with the strips 34, 36 as shown in FIG. 16(*c*).

It will be noted that the heated edge 46 is received in a trough 82 of the anvil 80 and that contact between the head 44 and the anvil 80 is not necessary to weld or to cut through the strips 34, 36, which are supported above the trough 82 by virtue of their tension. It will also be noted that the heated edge 46 lies between the stripper bar 74 and the trailing edge 28 of the blank 10, so that the weld 48 can be made as close to the blank 10 as possible.

As FIG. 16(*c*) shows, the head 44 with its associated stripper bar 74 moves with a box motion to suit continuous production in the machine 14. The anvil 80 must reciprocate horizontally to remain in alignment with the heated edge 46 of the head 44 during a welding and cutting stroke.

Figure 17:
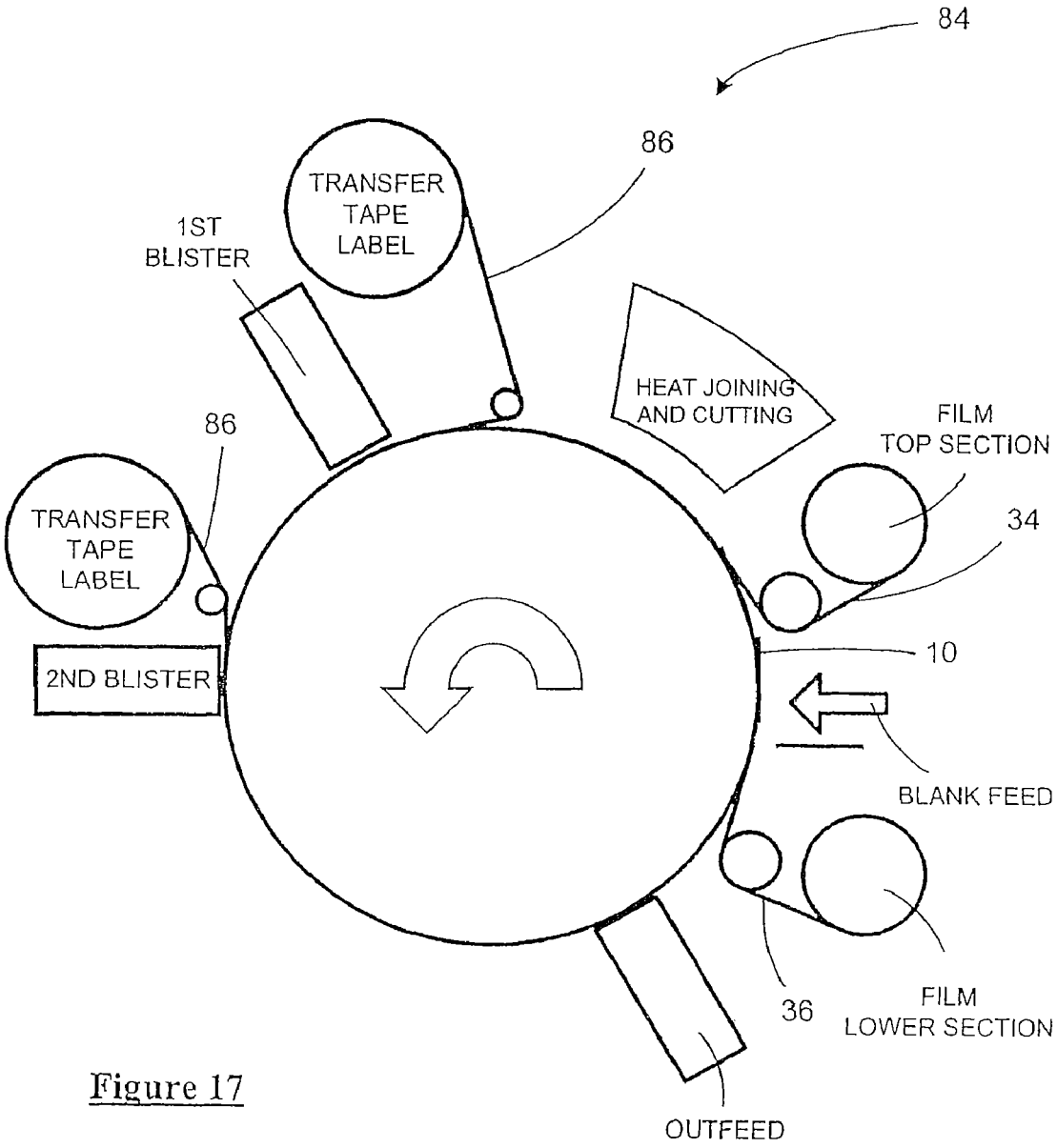
FIG. 17 is a schematic plan view of a rotary machine for performing the process steps of FIG. 1.

Referring next to FIG. 17 of the drawings, this shows that the invention may be embodied in a rotary machine 84 as well as the linear machine 14 illustrated in FIG. 2. Rotary machines tend to be faster than linear machines but they are less flexible as they are more difficult to adjust for different packages.

The flow is anti-clockwise in FIG. 17. The first operation is introduction of the lower strip 36. Moving anti-clockwise from there, this is followed by introduction of the blanks 10, then by introduction of the upper strip 34, followed by welding and cutting to form the bands 20. The packages 12 are then assembled by applying adhesive strip labels 54 from transfer tape 86, applying first blister packs 56 to one side of the bands 20, applying further adhesive strip labels 54, applying second blister packs 70 to the other side of the bands 20, and finally outfeeding the packages 12. Folding steps take place during the assembly operations but have been omitted from FIG. 17 for brevity.

Referring finally to FIGS. 18 to 25 of the drawings, these drawings show a practical embodiment of a machine for making a package in accordance with the invention. Where appropriate, like numerals are used for like parts.

Figure 18:
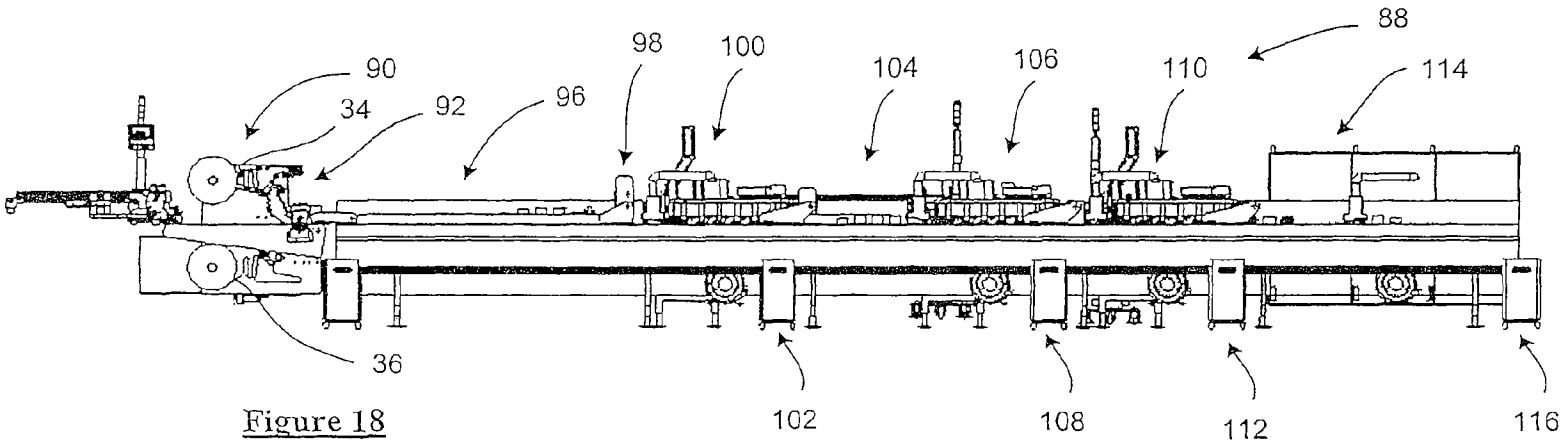
FIG. 18 is a side view of a practical embodiment of a machine for making a package in accordance with the invention.
Figure 19:
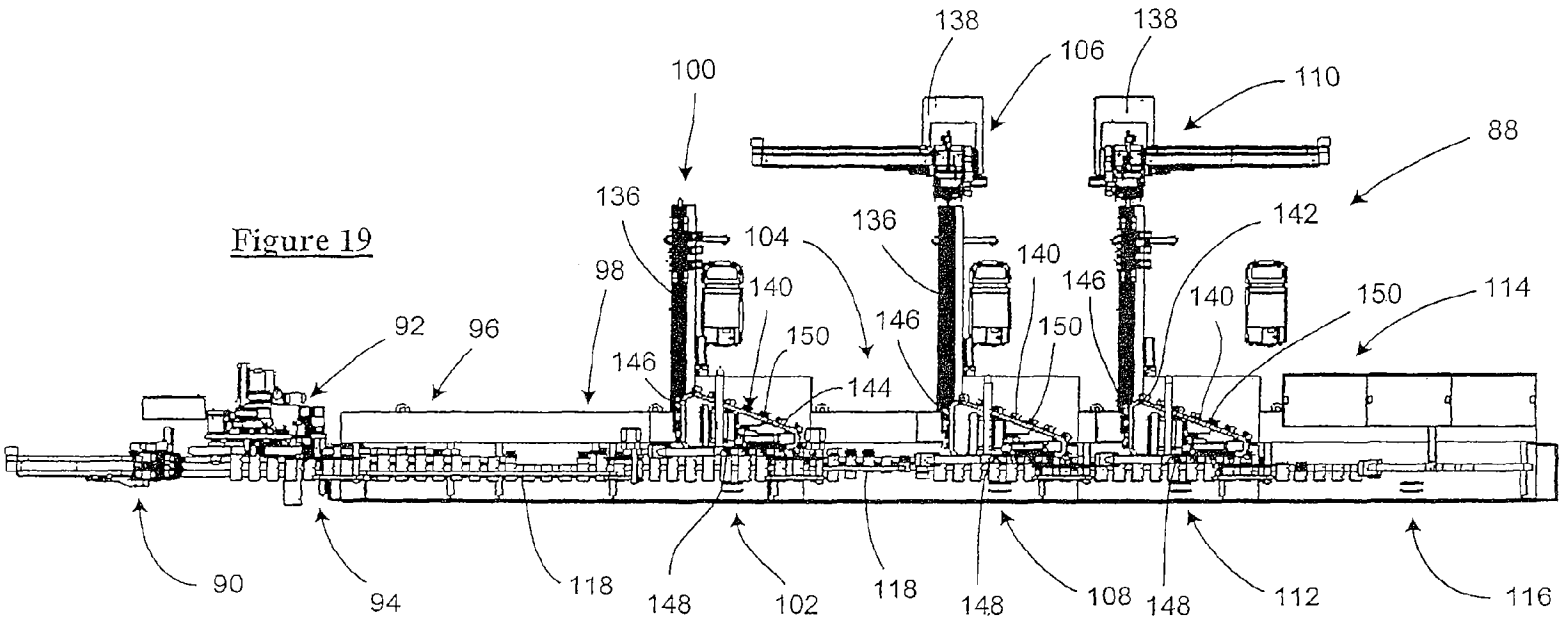
FIG. 19 is a plan view of the machine of FIG. 18.

FIGS. 18 and 19 show that the machine 88 comprises, in upstream to downstream order:

- a supply station 90 for supplying strips 34, 36 and blanks 10;
- a crimping station 92 at which the strips 34, 36 are brought together around the blanks 10, joined and cut to form a band 20 around each blank 10;
- a reject station 94 for rejecting imperfect products of the crimping station 92;
- a preliminary folding station 96 at which initial folds or creases are made in each blank 10;
- a band-advancing station 98 for advancing each band 20 around its associated blank 10 to bring the welds 48 inboard of the leading and trailing edges of the blank 10;
- a booklet-applying station 100 for applying a booklet to the band 20 around each blank 10;
- a reject station 102 for rejecting imperfect products of the booklet-applying station 100;
- a secondary folding station 104 at which further folds are made in each blank 10;
- a first tab-applying station 106 for applying a first blister pack 56, a pull or other tab member to the band 20 around each blank 10;
- a reject station 108 for rejecting imperfect products of the first tab-applying station 106;
- a second tab-applying station 110 for applying a second blister pack 70, a pull or other tab member to the band 20 around each blank 10;
- a reject station 112 for rejecting imperfect products of the second tab-applying station 110;
- a finishing station 114 for finishing the package, for example by making final folds and applying batch indicia to the package; and
- a reject station 116 for rejecting imperfect products of the finishing station 114.

Figure 20:
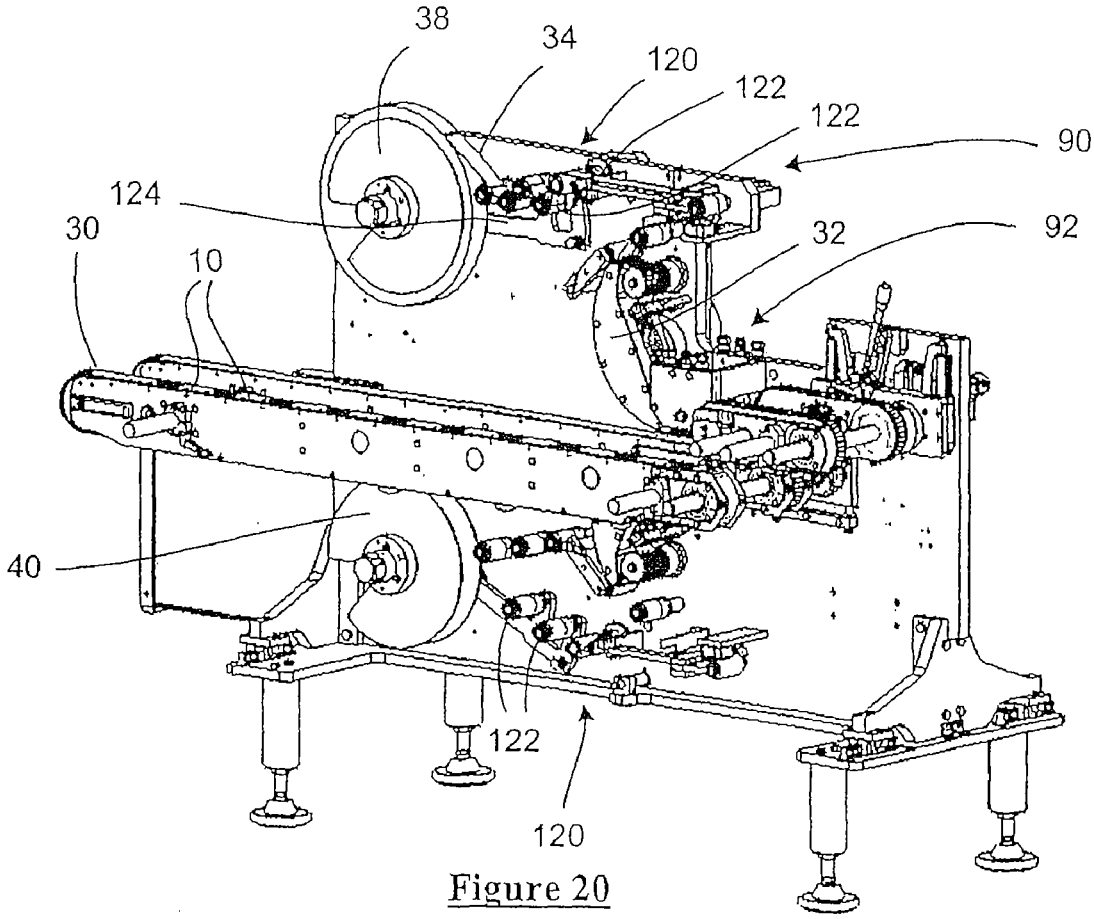
FIG. 20 is an enlarged detail perspective view of a supply station that supplies strips and blanks at an upstream end of the machine of FIGS. 18 and 19, and a crimping station of the machine downstream of the supply station.
Figure 21:
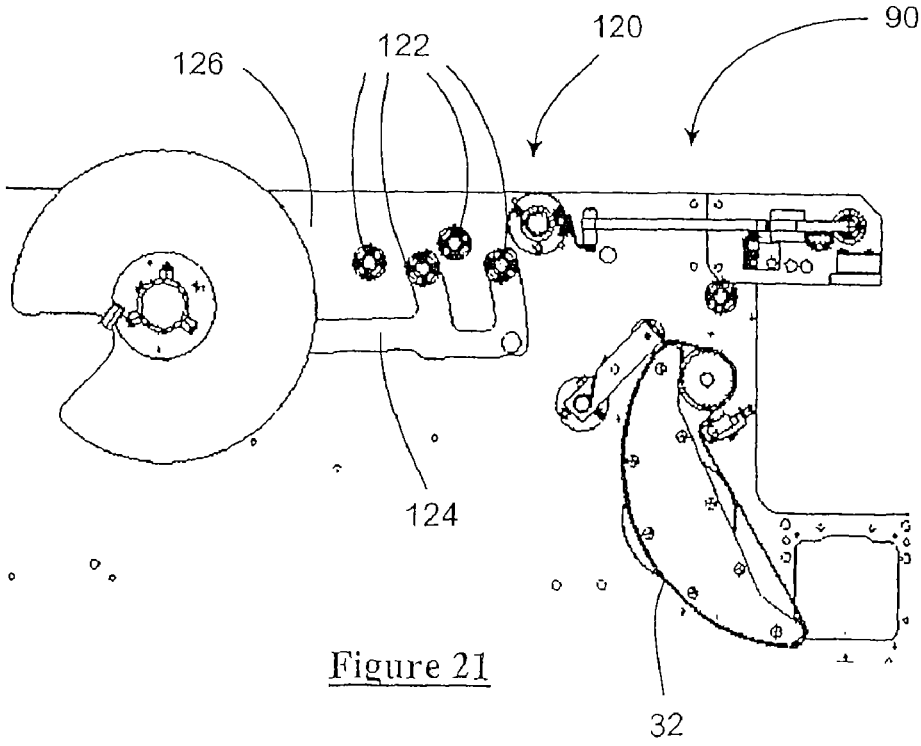
FIG. 21 is an enlarged detail side view of a strip feed mechanism of the supply station of FIG. 20.

The supply station 90 shown in FIGS. 20 and 21 is at the upstream end of the machine 88 shown in FIGS. 18 and 19. At the supply station 90, strips 34, 36 and blanks 10 are supplied from respective buffers and the strips 34, 36 converge around the blanks 10 in between.

The blanks 10 are supplied from cartridges (not shown) containing stacks of blanks. A friction feeder, for example as supplied by RonTech AG (trade mark), draws the blanks 10 from the cartridges and presents them to the machine 88, the blanks 10 being mutually spaced in transverse orientation. A horizontal primary conveyor 30 grips the full-width major portion of each blank 10. As before, a vacuum conveyor is preferred; the retaining force of the vacuum may be supplemented by fingers (not shown) upstanding from the belt of the conveyor 30 that embrace each blank 10.

At intervals, supplementary location means 118 cooperate with the primary conveyor 30 to prevent slippage of the blanks 10 with respect to the belt of the conveyor 30 during operations such as folding and placement of blister packs 56, 70. The supplementary location means 118—in this example, supplementary belts opposed to the belt of the primary conveyor 30—are visible in the plan view of the machine shown in FIG. 19.

As best understood with reference to the side view of FIG. 18 and the detail views of FIGS. 20 and 21, two identical strips 34, 36 of flexible plastics film are drawn from respective reels 38, 40 and fed to the crimping station 92 of the machine 88. One strip 34 is fed above the incoming blanks 10 and the other strip 36 is fed below, both in alignment with the neck portions 18 of the blanks 10.

Tension is maintained in the strips 34, 36 by respective tensioners 120 upstream of the crimping station 92. Each tensioner 120 passes a respective one of the strips 34, 36 in zigzag fashion through a set of rollers 122 before the strip 34, 36 enters the crimping station 92. In FIG. 20, the upper strip 34 is shown threaded through the rollers 122 of the upper tensioner 120 but the lower strip 36 visible in FIG. 18 has been omitted Comparison of the upper and lower tensioners 120 shows how in each case, two of the rollers 122 of each set are mounted on a swinging arm 124 for vertical movement relative to the other rollers 122 of the set, which are fixed to the structure 126 of the machine 88. Controlled relative movement between the rollers 122 imparts controllable tension to the strips 34, 36.

Immediately downstream of the tensioners 120, opposed vacuum-belt secondary conveyors 32 draw the strips 34, 36 from the tensioners 120 and into the crimping station 92. The relative speeds of the primary and secondary conveyors 30, 32 are varied dynamically to advance each blank 10 against the weld at the leading edge of the blank as explained previously. This can be achieved by momentarily accelerating the primary conveyor 30 or by momentarily decelerating the secondary conveyors 32

Figure 22:
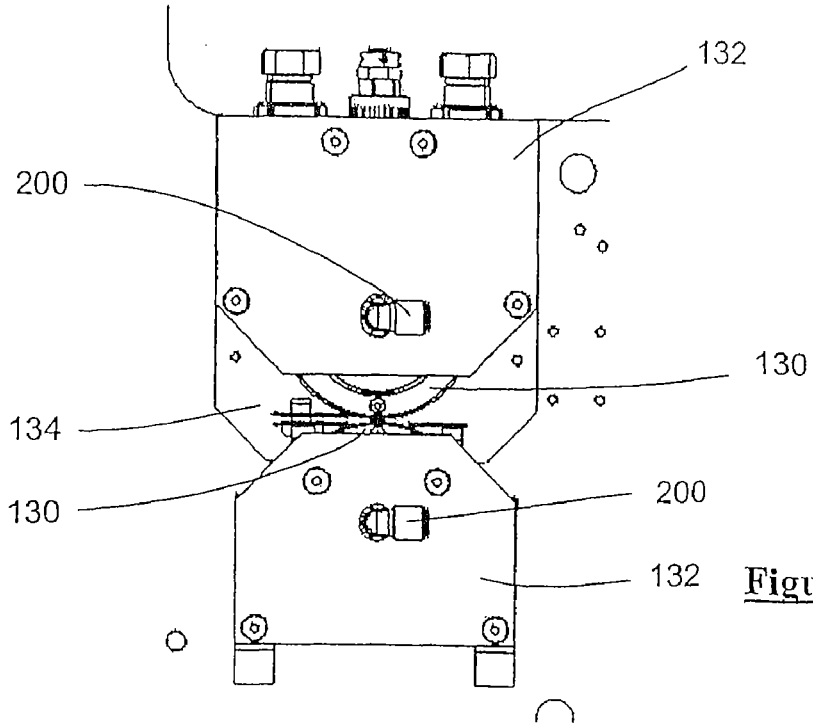
FIG. 22 is an enlarged detail side view of the crimping station shown in FIG. 20, downstream of the supply station.
Figure 23:
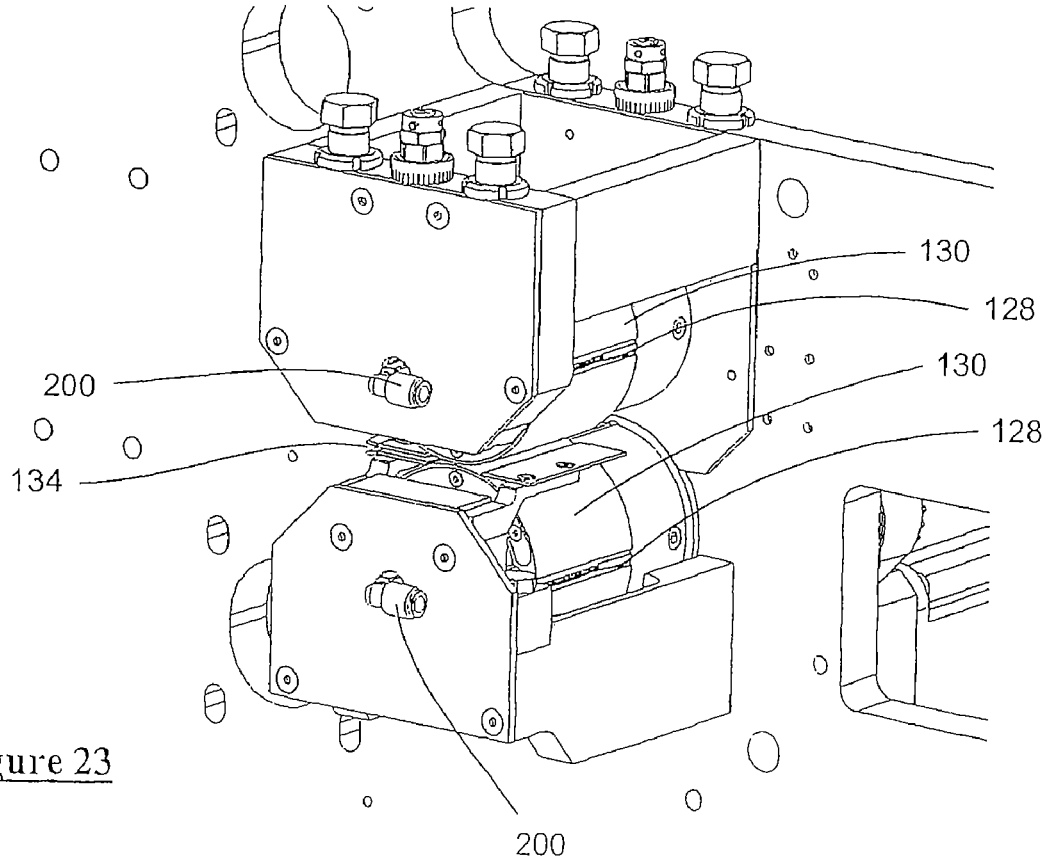
FIG. 23 is a perspective view of the crimping station corresponding to FIG. 22.
Figure 24:
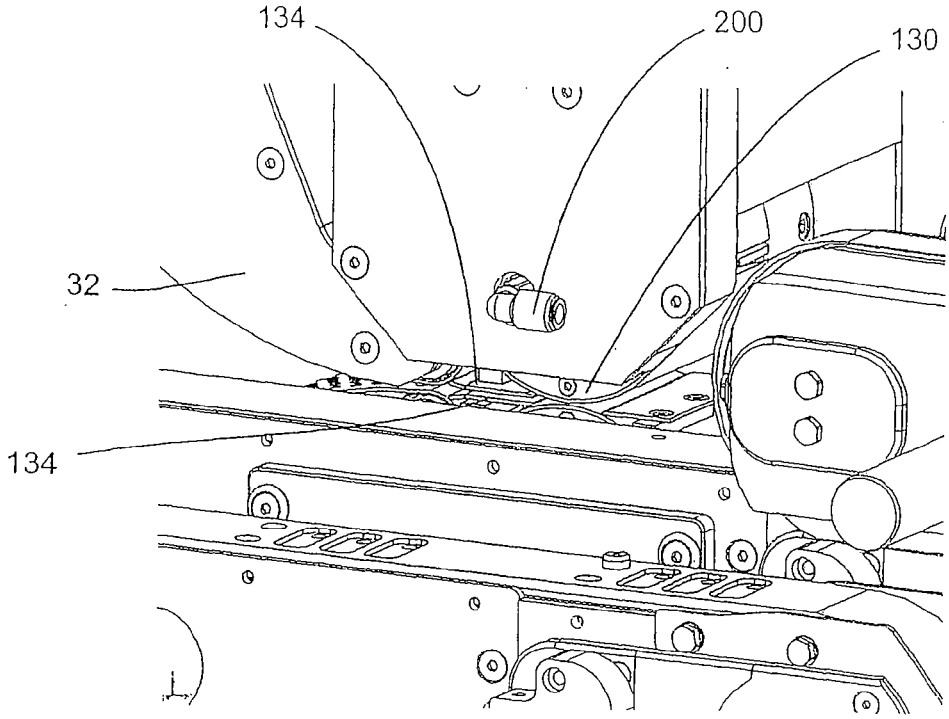
FIG. 24 is a further enlarged detail perspective view of the crimping station shown in FIGS. 21 to 23.
Figure 25:
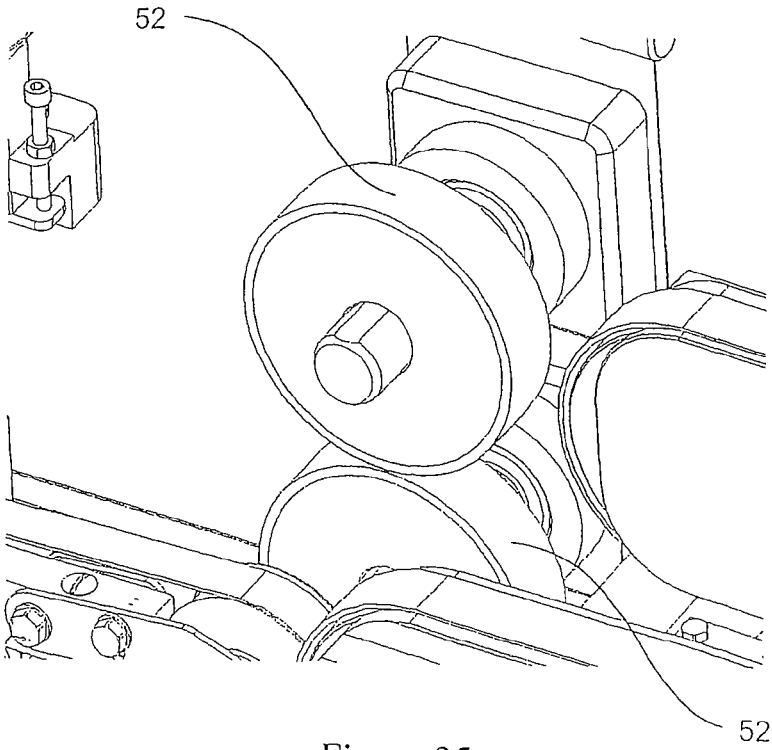
FIG. 25 is an enlarged detail perspective view of contra-rotating rollers of the machine of FIGS. 18 and 19, for advancing bands around their associated blanks.

Moving on now to FIGS. 22 to 24, these show that the crimping station 92 of the embodiment shown in FIGS. 18 to 25 takes a different approach to the design of the welding and cutting head. In this embodiment, opposed heated blades 128 are mounted on cooled contra-rotating drums 130 between which blanks 10 and strips 34, 36 are fed. The drums 130 are mounted for rotation about parallel horizontal axes in brackets 132 attached to the structure 126 of the machine 88 and are cooled in conventional fashion by a refrigerant which enters the drums via a respective inlets 200.

In this example, each drum 130 carries two blades 128, 180° apart. The rotation of the drums 130 is synchronised with the speed of the incoming blanks 10 and strips 34, 36 so that the blades crimp the strips 34, 36 between each blank 10. The rotation of the drums 130 is also mutually synchronised so that the blades 128 of the opposed drums come together in pairs to crimp, weld and cut through the aligned strips 34, 36 from above and below simultaneously. To permit the blades 128 to apply inward pressure on the strips 34, 36 for long enough to achieve welding and cutting without interrupting the flow of blanks 10 through the machine 88, the blades 128 are mounted resiliently to the drums. This permits inward radial movement of the blades 128 with respect to the drums 130 as the opposed blades 128 of each pair come together on each rotation of the drums 130. Thus, the blades 128 of each pair can apply inward pressure on the strips 34, 36 for longer than the instantaneous period that would otherwise be possible. The cooling of the drums ensures that there is no undesired melting or deformation of the strips 34, 36 between the welds formed by the opposed blades 128.

FIG. 24 shows how the perforated secondary conveyors 32 feed the strips 34, 36 between opposed guide plates 134 immediately upstream of where the blades 128 of the drums 130 come together. As the leading edge of each blank 10 is pressed against the adjacent weld before the next weld is made behind the blank 10 to create a band 20, tension is maintained in the strips 34, 36 up to the point where the band 20 of each blank 10 is created.

In the reject station 94 for rejecting imperfect products of the crimping station 92, vision sensors (not shown) determine whether a band 20 has been correctly formed around each blank 10. If a band 20 has not been correctly formed, that blank 10 is rejected at the reject station 94. Additionally, the machine 88 may be programmed to stop if a set number of consecutive bands 20 is not correctly formed so that a failure analysis can take place. Similar vision sensors systems are used to implement the remaining reject stations 102, 108, 112, 116 of the machine 88.

If a band 20 has been correctly formed, the blank 10 is carried by the primary conveyor 30 through the preliminary folding station 96 at which initial folds or creases are made in each blank 10. From there, the blank 10 passes through the band-advancing station 98 at which contra-rotating rollers 52 shown in FIG. 25 advance the band 20 around the blank 10 to bring the welds inboard of the leading and trailing edges of the blank 10. The rollers 52 are driven by respective servos so that their speeds of rotation can be individually adjusted to advance the bands as desired.

In the embodiment shown in FIGS. 18 to 25, there is provision to apply a booklet and two tab members such as blisters packs 56, 70 to the band 20 of each blank 10. It is emphasised that a booklet is optional and that one or both of the blister packs 56, 70 could be replaced by a pull member or other tab member.

The booklet is applied first at the booklet-applying station 100. The operation of the booklet-applying station 100 is similar to that of the first and second tab-applying stations 106, 110. The following description will therefore suffice for each station 100, 106, 110. At each station, hot-melt glue is applied in dots to the band 20 of each blank by gluing apparatus as supplied by, for example, Robatech AG. Booklets or tab members are then applied to the glue under downward pressure maintained long enough for a sufficient bond to form before the blanks are released for downstream processing.

As best shown in the plan view of the machine 88 in FIG. 19, the booklets and tab members are fed in transversely by respective supply conveyors 136 disposed orthogonally to the primary conveyor 30. Buffers 138 are shown at the upstream ends of the supply conveyors 136 associated with the first and second tab-applying stations 106, 110. Booklets and tab members are spaced along the respective supply conveyors 136 to arrive in synchronism with the flow of blanks 10 past the downstream ends of the supply conveyors 136.

At the downstream end of each supply conveyor 136, a pick-and-place carousel 140 picks each booklet or tab member off its respective supply conveyor 136, reorients the booklet or tab member to suit the blanks 10, places the booklet or tab member upon the glue dots associated with each blank 10 and presses down the booklet or tab member for the necessary duration without interrupting the flow of blanks 10. To do this, the pick-and-place carousel 140 follows the general principle disclosed in U.S. Pat. No. 6,578,614 to Loewenthal, Assignee Sigpack Systems AG.

Each pick-and-place carousel 140 comprises a belt 142 that supports carriers 144 spaced to correspond to the pitch from blank to blank on the primary conveyor 30. The belt 142 turns anti-clockwise about vertical-axis rollers on a triangular path in plan view. The triangular path comprises: a pick section 146 extending over and parallel to the associated supply conveyor 136; a place section 148 orthogonal to the pick section 146 and extending over and parallel to the primary conveyor 30; and a return section 150 being the hypotenuse of the triangular path. The carriers 144 are mounted for vertical movement with respect to the belt 142.

At the pick section, each carrier 144 is driven down with respect to the belt 142 to pick up a respective booklet or tab member. The carrier 144 is then raised to lift the booklet or tab member off the supply conveyor 136. As the belt 142 turns the corner between the mutually-orthogonal pick and place sections 146, 148, the carrier 144 turns through 90° to reorient the booklet or tab member to match the orientation of the blanks 10. At the upstream end of the place section 148, the carrier 144 is again driven down with respect to the belt 142 to press the booklet or tab member against the waiting glue dots and to maintain that downward pressure for the length of the place section 148. At the downstream end of the place section 148, the carrier 144 is raised away from the booklet or tab member. The carrier 144 then returns along the return section 150 to start again at the pick section 146.

Cam surfaces (not shown) may be used to drive the upward and downward movements of the carriers 144 with respect to the belt 142 on the pick and place sections 146, 148 of the path.

The blanks are suitably of cardboard although other materials such as plastics are possible. The invention has been tested to proof-of-concept stage with cardboard blanks of 0.38 mm thickness and a density of approximately 290 g/m$^2$.

A stack of 1500 of such blanks would be 570 mm high and would permit five minutes of machine running at 300 packages per minute—a rate somewhat faster than a single-lane, single-head machine of the invention would be expected to operate.

The plastics film used in the strips is suitably polypropylene film as sold under the trade mark Treofan GND. Alternatively, polyethylene film may be used, although this is more prone to stretching. Proof-of-concept testing has been performed with Treofan GND film of 30 μm thickness, with a tension of 38 grams and with a welding and cutting tool temperature of 250±5 Celsius and a stainless steel welding edge with a land of 0.5 mm, this effecting welding and cutting in 0.15 seconds. Treofan GND film of 25 μm thickness has also been tested successfully. In these tests, the width of the strips was 46 mm and the cut length between successive welds was 88 mm.

Reels of Treofan GND of 30 μm thickness are available with a length of 1175 metres. At 300 packs per minute, the time between reel changes would be approximately 45 minutes. Larger reels of Treofan GND are available, allowing correspondingly longer times between reel changes.

Many variations are possible without departing from the inventive concept. For instance, the way in which the blank is folded in the foregoing description is merely for illustration and can readily be varied in practice: folding means other than plough folding guides will be known to those familiar with the packaging field. Both the blanks and the film may be of different materials or of different thicknesses or compositions.

The welding edge of the welding and cutting head may be replaced by a hot wire, which may be of PTFE-coated stainless steel. An advantage of a wire is that the wire can be advanced to present a fresh welding surface from time to time. The wire may be recirculated after passing through a scraper to remove any welding residues that may have adhered to the wire.

It is possible for the welding edge of the head simply to weld the strips but not to cut through them, such that the strips can subsequently be cut or broken along the weld. Other variants are possible in which joining of the strips is effected by a laser, by adhesive, by ultrasound or under fusing pressure. Similarly, cutting can be achieved by means other than a hot edge, such as a sharp blade or a laser.

Whilst the head is shown with one stripper bar in FIG. 16(*a*) to 16(*c*), it is possible for more than one stripper bar to be used, for example one stripper bar to each side of the head.

The use of two blister packs as tab members is merely an illustrative option. There may be only one blister pack, with the other tab member simply being a pull-out tab that drives the blister pack out of the sleeve in the opposite direction. That pull-out tab may, nevertheless, bear marketing material or product information, and may comprise or consist of a fold-out leaflet that may be attached in broadly the same manner as the second blister pack described above.

It is possible for more than one band to be applied to a single blank or other substrate. It is also possible for the blank to be folded to produce a carton and for the tab members to be attached subsequently to the band through the open ends of the carton sleeve.

In view of these and other variants of the invention, reference should be made to the appended claims rather than to the foregoing specific description to determine the scope of the invention.

What is claimed is:

1. A method of making a band-drive component for a package, the method comprising:

feeding first and second flexible webs in a feed direction, one web being fed each side of a substrate such that the webs are in mutual face-to-face disposition ahead of and behind the substrate with respect to the feed direction;

joining the face-to-face webs at a first join ahead of the substrate and at a second join behind the substrate, the joins bounding web portions that together encircle the substrate between the joins;

dividing the joined web portions from the remainder of the webs such that the joined web portions together define a band that encircles the substrate, to be slid around the substrate in use of the package; and wherein relative longitudinal movement is caused between the substrate and webs such that the substrate moves closer to the first join after the first join has been made.

2. The method of claim 1, wherein the webs run parallel to each other in the feed direction where the substrate is between the webs.

3. The method of claim 1, wherein the substrate is a flat panel.

4. The method of claim 1, wherein the band can slide in use around a leading edge of the substrate and a trailing edge of the substrate parallel to the leading edge, the edges being orthogonal to the feed direction of the webs.

5. The method of claim 1, wherein the webs are aligned with a neck portion of the substrate such that the band encircles the substrate at the neck portion.

6. The method of claim 1, wherein the substrate is a carton blank.

7. The method of claim 6, wherein panels of the carton blank are subsequently folded around the band.

8. The method of claim 7, wherein the panels define a sleeve of a package.

9. The method of claim 1, wherein the web portions are divided from the web along a join.

10. The method of claim 1, wherein the joins are effected by welding.

11. The method of claim 10, wherein the web portions are divided from the web by melting through the web after welding.

12. The method of claim 1, comprising pressing together the webs before joining.

13. The method of claim 1, wherein relative longitudinal movement between the substrate and the webs ends when the substrate bears against the first join.

14. The method of claim 1, wherein the substrate moves more quickly in the feed direction than the webs.

15. The method of claim 1, wherein a speed differential between the substrate and the webs is varied during a band-forming cycle.

16. The method of claim 1, wherein the substrate is driven by a primary conveyor and the webs are driven by a secondary conveyor moving at a lower speed than the primary conveyor.

17. The method of claim 1, wherein the second join is made after the first join.

18. The method of claim 17, wherein relative movement between the substrate and the first join takes place after the first join is made and before the second join is made.

19. The method of claim 18, wherein relative longitudinal movement between the substrate and the webs ends when the substrate bears against the first join, and wherein the second join is made when the substrate bears against the first join.

20. The method of claim 1, wherein the second join is made immediately behind the substrate.

21. The method of claim 1, wherein a plurality of substrates are fed successively between the webs, and the webs are joined in gaps between successive substrates of the plurality.

22. The method of claim 21, wherein the second join behind one substrate is also the first join ahead of the succeeding substrate.

23. The method of claim 1, wherein the band is advanced around the substrate to move the joins inboard of leading and trailing edges of the substrate.

24. The method of claim 23, wherein the band is advanced by relative movement between the substrate and a band drive in contact with the band.

25. The method of claim 24, wherein the substrate is driven by a primary conveyor and the webs are driven by a secondary conveyor moving at a lower speed than the primary conveyor, and wherein the band drive is the secondary conveyor.

26. The method of claim 24, wherein the band drive comprises pinch rollers.

27. The method of claim 1, further comprising applying at least one tab member or insert to the band.

28. The method of claim 27, wherein the tab member or insert is adhesively attached to the band and adhesive is applied to overlay or straddle a join of the band.

29. The method of claim 28, wherein the tab member or insert is pressed against the band for a bond-forming period.

30. An apparatus for making a band-drive component for a package, the apparatus comprising:

web feeders for feeding first and second flexible webs in a feed direction, one web being fed each side of a substrate such that the webs are in mutual face-to-face disposition ahead of and behind the substrate with respect to the feed direction;

a web joiner for joining the face-to-face webs at a first join ahead of the substrate and at a second join behind the substrate, the joins bounding web portions that together encircle the substrate between the joins;

a web divider for dividing the joined web portions from the remainder of the webs such that the joined web portions together define a band that encircles the substrate, to be slid around the substrate in use of the package; and wherein the substrate and the webs are driven by respective drives, the drives bring arranged to effect relative movement between the substrate and the webs such that the substrate moves closer to the first join after the first join has been made.

31. The apparatus of claim 30, wherein the web joiner and the web divider are the same component.

32. The apparatus of claim 30, wherein the web joiner comprises opposed heated blades for crimping the face-to-face webs.

33. The apparatus of claim 32, wherein the blades are carried by respective drums, one each side of the substrate and the webs.

34. The apparatus of claim 30, further comprising a web presser associated with the web joiner for pressing together the webs before joining.

35. The apparatus of claim 30 wherein, in use, the substrate drive moves more quickly in the feed direction than the web drive.

36. The apparatus of claim 35, wherein the substrate drive is a primary conveyor and the web drive is a secondary conveyor moving at a lower speed than the primary conveyor.

37. The apparatus of claim 35, wherein the web drive continues to engage the web after the band is formed so as to advance the band around the substrate.

38. The apparatus of claim 35, comprising pinch rollers for advancing the band around the substrate.

39. The apparatus of claim 30, wherein a speed differential between the substrate and the webs is varied during a band-forming cycle.

40. The apparatus of claim 30, further comprising an application station for applying at least one tab member or insert to the band.

41. The apparatus of claim 40, wherein the application station attaches the tab member or insert to the band with adhesive and is arranged to attach the tab member to the band at the location of a join.

42. The apparatus of claim 41, wherein the application station is adapted to press the tab member or insert against the band for a bond-forming period.

43. The apparatus of claim 42, wherein the application station comprises a carrier movable in the feed direction to hold the tab member or insert against the band as the band and the substrate move in the feed direction.

44. The apparatus of claim 43, wherein the carrier is also movable transverse to the feed direction, towards and away from the band and the substrate.

45. The apparatus of claim 30, further comprising a folding station for folding the substrate.

46. A method of making a band-drive component for a package, the method comprising:

feeding first and second flexible webs in a feed direction, one web being fed each side of a substrate such that the webs are in mutual face-to-face disposition ahead of and behind the substrate with respect to the feed direction;

joining the face-to-face webs at a first join ahead of the substrate and at a second join behind the substrate, the joins bounding web portions that together encircle the substrate between the joins; and dividing the joined web portions from the remainder of the webs such that the joined web portions together define a band that encircles the substrate, to be slid around the substrate in use of the package;

wherein the band is advanced around the panel to move the joins inboard of leading and trailing edges of the panel.

47. The method of claim 46, wherein the webs run parallel to each other in the feed direction where the substrate is between the webs.

48. The method of claim 46, wherein the substrate is a flat panel.

49. The method of claim 46, wherein the band can slide in use around a leading edge of the substrate and a trailing edge of the substrate parallel to the leading edge, the edges being orthogonal to the feed direction of the webs.

50. The method of claim 46, wherein the webs are aligned with a neck portion of the substrate such that the band encircles the substrate at the neck portion.

51. The method of claim 46, wherein the substrate is a carton blank.

52. The method of claim 51, wherein panels of the carton blank are subsequently folded around the band.

53. The method of claim 52, wherein the panels define a sleeve of a package.

54. The method of claim 46, wherein the web portions are divided from the web along a join.

55. The method of claim 46, wherein the joins are effected by welding.

56. The method of claim 55, wherein the web portions are divided from the web by melting through the web after welding.

57. The method of claim 46, comprising pressing together the webs before joining.

58. The method of claim 46, wherein the band is advanced by relative movement between the substrate and a band drive in contact with the band.

59. The method of claim 58, wherein the substrate is driven by a primary conveyor and the webs are driven by a secondary conveyor moving at a lower speed than the primary conveyor, and wherein the band drive is the secondary conveyor.

60. The method of claim 58, wherein the band drive comprises pinch rollers.

61. The method of claim 46, wherein the band can slide in use around a leading edge of the substrate and a trailing edge of the substrate parallel to the leading edge, the edges being orthogonal to the feed direction of the webs.

62. The method of claim 46, further comprising applying at least one tab member or insert to the band.

63. The method of claim 62, wherein the tab member or insert is adhesively attached to the band and adhesive is applied to overlay or straddle a join of the band.

* * * * *